US005265581A

United States Patent [19]

Nagaishi

[11] Patent Number: 5,265,581

[45] Date of Patent: Nov. 30, 1993

[54] AIR-FUEL RATIO CONTROLLER FOR WATER-COOLED ENGINE

[75] Inventor: Hatsuo Nagaishi, Yokohama, Japan

[73] Assignee: Nissan Motor Co., Ltd., Kanagawa, Japan

[21] Appl. No.: 798,920

[22] Filed: Nov. 29, 1991

[30] Foreign Application Priority Data

| | | | |
|---|---|---|---|
| Nov. 30, 1990 | [JP] | Japan | 2-333525 |
| Nov. 30, 1990 | [JP] | Japan | 2-333526 |
| Nov. 30, 1990 | [JP] | Japan | 2-333528 |
| Nov. 30, 1990 | [JP] | Japan | 2-333529 |
| Nov. 30, 1990 | [JP] | Japan | 2-333530 |
| Dec. 26, 1990 | [JP] | Japan | 2-414389 |

[51] Int. Cl.[5] ..... F02D 41/14

[52] U.S. Cl. ..... 123/675

[58] Field of Search ..... 123/675, 674, 480, 486, 123/492, 493, 695

[56] References Cited

U.S. PATENT DOCUMENTS

| | | | |
|---|---|---|---|
| 4,667,640 | 5/1987 | Sekozawa et al. | 123/480 |
| 4,905,653 | 3/1990 | Manaka et al. | 123/674 |
| 4,919,094 | 4/1990 | Manaka et al. | 123/493 |

FOREIGN PATENT DOCUMENTS

| | | | |
|---|---|---|---|
| 60-145443 | 7/1985 | Japan . | |
| 63-38645 | 2/1988 | Japan . | |
| 63-38656 | 2/1988 | Japan | 123/675 |
| 63-41635 | 2/1988 | Japan . | |

*Primary Examiner*—Andrew M. Dolinar

*Attorney, Agent, or Firm*—Lowe, Price, LeBlanc & Becker

[57] ABSTRACT

An air-fuel controller for a water-cooled engine provided with a mechanism for detecting a mixing ratio error which is a difference between a target mixing ratio and a real mixing ratio of fuel and air provided for the engine, a mechanism for performing learning related to a fuel injection amount based on the detected mixing ratio error, a memory for storing this learned value, a mechanism for computing a fuel injection correction amount based on this learned value, and a mechanism for outputting a fuel injection amount corrected by this correction amount to the fuel injector. This engine may be provided for example with a mechanism to set the difference between the mixing ratio error in the transient state and after the transient state has terminated as a transient mixing ratio error, and a mechanism to update the learned value stored in the memory such that the transient mixing ratio error is minimized. In this manner, learning precision in air-fuel ratio control is improved.

9 Claims, 38 Drawing Sheets

AIR-FUEL RATIO CONTROLLER FOR WATER-COOLED ENGINE

FIELD OF THE INVENTION

This invention relates to an engine air-fuel ratio (AFR) controller, and more specifically, a controller which not only provides feedback control of the AFR but also learning control of the AFR by means of previously learned correction values.

BACKGROUND OF THE INVENTION

In order to make effective use of a three-way catalyzer used to process CO, HC and NOx, which are toxic substances present in engine exhaust gases, the engine must be operated at the theoretical AFR.

In engines using a three-way catalyzer to process exhaust gases, an $O_2$ sensor installed in the exhaust manifold is used to detect whether the combustion is on the rich or on the lean side, and the AFR is feedback-controlled to a theoretical AFR by adjusting the fuel supplied by a fuel injection valve based on the detected value.

However it is difficult to ensure sufficient response capacity from this kind of feedback control.

Tokkai Sho 60-145443, 63-41635 and 63-38645 published by Japanese Patent Office therefore disclose methods of improving the response and control precision by learning during a sampling period under a variety of different conditions, and applying correction values based on these learned values to control the AFR.

This system is applied to fuel injection devices of the L-Jetronic type, wherein the injection pulse width TI corresponding to the quantity of fuel required in one ignition cycle is given by the following relation:

$$TI = Tp \times Co \times \alpha \times \alpha m + Ts$$

where

Tp is the basic pulse width of a fuel injection.

$$Tp = K \times Qa/N$$

K is a constant, Qa is intake volume and N is engine speed $\alpha$ is an AFR feedback control coefficient calculated according to the deviation between the real mixing ratio and a predetermined target ratio. The mixing ratios are calculated from the AFR by the equation:

| | |
|---|---|
| Real mixing ratio = | real fuel-air ratio/ theoretical fuel-air ratio |
| Target mixing ratio = | target fuel-air ratio/ theoretical fuel-air ratio |
| AFR = 1/fuel-air ratio | |

Co are various correction coefficients to improve specific running conditions of the engine.

Ts is a non-effectual pulse width.

Here, $\alpha m$ is an AFR learning correction coefficient introduced for the purpose of improving the response of the AFR correction. These parameters may be represented by a learning area for storage of AFR coefficients $\alpha m$. This learning area is divided into a plurality of small areas with Tp and N as coordinates, and $\alpha m$ is updated in each small area.

In one small area, for example, when a certain set of predetermined conditions are satisfied, (e.g. the AFR feedback signal is sampled a certain number of times during feedback control), updated learned values are calculated from an intermediate value $L_{MD}$, of $\alpha$ computed from the AFR sensor output and a learned value which previously occupied this small area, and the result of this calculation is stored in the same area.

This type of learning control is effective in reducing exhaust emissions. However, under transient conditions such as acceleration, the running condition of the engine varies widely during a sampling period so that high learning precision cannot be attained, and AFR values tend to become widely scattered temporarily.

SUMMARY OF THE INVENTION

It is therefore an object of the invention to improve the learning precision of engine AFR control.

In order to achieve the above object, this invention provides an air-fuel ratio controller for a water-cooled engine having a cylinder, an intake passage surrounded by a wall which provides air to the cylinder, and a fuel injector injecting fuel in the intake passage. The controller comprises sensors for detecting engine load and speed, means for computing a basic fuel injection amount of the fuel injector based on the detected value of the engine load and speed, a sensor for detecting engine coolant water temperature, a sensor for detecting a real mixing ratio of the fuel and air provided in the cylinder by the fuel injector and intake passage, means for detecting a mixing ratio error from a difference between the value detected by the mixing ratio sensor and a predetermined target mixing ratio, means for judging whether or not the engine is in a transient state, means for computing a basic correction amount regarding a wall flow according to the detected value of water temperature, this wall flow being a flow of fuel along the wall of the intake passage, means for performing learning related to the wall flow correction based on the mixing ratio error detected by the mixing ratio error detection means when the engine is in the transient state, a memory for storing the transient learned value, means for searching the transient learned value in the memory when the engine re-enters the transient state, means for computing a wall flow correction amount based on the searched transient learned value and the basic correction amount of the wall flow, means for correcting the basic fuel injection amount by the computed wall flow correction amount, means for outputting the corrected injection amount to the fuel injector, means for judging whether or not the transient state has terminated, means for setting the difference between the outputs of the mixing ratio error detecting means in the transient state and after termination of the transient state, as a transient mixing ratio error, and means for updating the transient learned value stored in the memory such that the transient mixing ratio error decreases.

This invention also provides an air-fuel ratio controller for a water-cooled engine comprising sensors for detecting engine load and speed, means for computing a basic fuel injection amount of the fuel injector based on the detected value of the engine load and speed, a sensor for detecting engine coolant water temperature, a sensor for detecting a real mixing ratio of the fuel and air provided in the cylinder by the fuel injector and intake passage, means for detecting a mixing ratio error from a difference between the value detected by the mixing ratio sensor and a predetermined target mixing ratio, means for averaging the output of the mixing ration error detecting means, means for judging whether or not the engine is in a transient state, means for computing a basic correction amount regarding a wall flow according to the detected value of water temperature, this wall flow being a flow of fuel along the wall of the intake passage, means for performing learning related to the wall flow correction based on the mixing ratio error detected by the mixing ratio error detection means when the engine is in the transient state, a memory for storing the transient learned value, means for searching the transient learned value in the memory when the engine re-enters the transient state, means for computing a wall flow correction amount based on the searched transient learned value and the basic correction amount of the wall flow, means for correcting the basic fuel injection amount by the computed wall flow correction amount, means for outputting the corrected injection amount to the fuel injector, means for judging whether or not the transient state has terminated, means for setting the difference between the output of the mixing ratio error detecting means in the transient state and the output of the averaging means after the termination of the transient state, as a transient mixing ratio error, and means for updating the transient learned value stored in the memory such that the transient mixing ratio error decreases.

This invention also provides an air-fuel ratio controller for a water-cooled engine comprising sensors for detecting engine load and speed, means for computing a basic fuel injection amount of the fuel injector based on the detected value of the engine load and speed, a sensor for detecting engine coolant water temperature, a sensor for detecting a real mixing ratio of the fuel and air provided in the cylinder by the fuel injector and intake passage, means for detecting a mixing ratio error from a difference between the value detected by the mixing ratio sensor and a predetermined target mixing ratio, means for judging whether or not the engine is in a transient state, means for computing a basic correction amount regarding a wall flow according to the detected value of water temperature, this wall flow being a flow of fuel along the wall of the intake passage, means for performing learning related to the wall flow correction based on the mixing ratio error detected by the mixing ratio error detection means when the engine is in the transient state, a memory for storing the transient learned value, means for searching the transient learned value in the memory when the engine re-enters the transient state, means for computing a wall flow correction amount based on the searched transient learned value and the basic correction amount of the wall flow, means for correcting the basic fuel injection amount by the computed wall flow correction amount, means for outputting the corrected injection amount to the fuel injector, means for judging whether or not the transient state has terminated, means for judging whether the engine is in a pre-transient state, means for setting the difference between the outputs of the mixing ratio error detecting means in the pre-transient state and after the termination of the transient state, as a transient mixing ratio error, and means for updating a transient learned value stored in the memory such that the transient mixing ratio error decreases.

This invention also provides an air-fuel ratio controller for a water-cooled engine comprising sensors for detecting engine load and speed, means for computing a basic fuel injection amount of the fuel injector based on the detected value of the engine load and speed, a sensor for detecting engine coolant water temperature, a sensor for detecting a real mixing ratio of the fuel and air provided in the cylinder by the fuel injector and intake passage, means for detecting a mixing ratio error from a difference between the value detected by the mixing ratio sensor and a predetermined target mixing ratio, means for judging whether or not the engine is in a transient state, means for computing a basic correction amount regarding a wall flow according to the detected value of water temperature, this wall flow being a flow of fuel along the wall of the intake passage, means for performing learning related to the wall flow correction based on the mixing ratio error detected by the mixing ratio error detection means when the engine is in the transient state, a memory for storing the transient learned value, means for searching the transient learned value in the memory when the engine re-enters the transient state, means for computing a wall flow correction amount based on the searched transient learned value and the basic correction amount of the wall flow, means for correcting the basic fuel injection amount by the computed wall flow correction amount, means for outputting the corrected injection amount to the fuel injector, means for computing an integral value of the mixing ratio error in a predetermined sampling interval based on the output of the mixing ratio error detecting means under the transient conditions, and for computing the maximum and minimum values of the mixing ratio error in this interval, and means for updating the transient learned value stored in the memory based on these three values such that the mixing ratio error in the transient state decreases.

This invention also provides an air-fuel ratio controller for a water-cooled engine comprising sensors for detecting engine load and speed, means for computing a basic fuel injection amount of the fuel injector based on the detected value of the engine load and speed, a sensor for detecting engine coolant water temperature, a sensor for detecting a real mixing ratio of the fuel and air provided in the cylinder by the fuel injector and intake passage, means for detecting a mixing ratio error from a difference between the value detected by the mixing ratio sensor and a predetermined target mixing ratio, means for judging whether or not the engine is in a transient state, means for computing a basic correction amount regarding a wall flow according to the detected value of water temperature, this wall flow being a flow of fuel along the wall of the intake passage, means for performing learning related to the wall flow correction based on the mixing ratio error detected by the mixing ratio error detection means when the engine is in the transient state, a memory for storing the transient learned value, means for searching the transient learned value in the memory when the engine re-enters the transient state, means for computing a wall flow correction amount based on the searched transient learned value and the basic correction amount of the wall flow, means for correcting the basic fuel injection amount by the computed wall flow correction amount, means for outputting the corrected injection amount to the fuel injector, means for updating the transient learned value stored in the memory such that the mixing ratio error under the transient state decreases, means for judging whether the engine is in a pre-transient state, means for judging whether or not the mixing ratio error detected in the pre-transient state lies within a predetermined range, and means for prohibiting updating of the transient learned values when the pre-transient error does not lie within the predetermined range.

This invention also provides an air-fuel ratio controller for a water-cooled engine comprising sensors for detecting engine load and speed, means for computing a basic fuel injection amount of the fuel injector based on the detected value of the engine load and speed, a sensor for detecting engine coolant water temperature, a sensor for detecting a real mixing ratio of the fuel and air provided in the cylinder by the fuel injector and intake passage, means for detecting a mixing ratio error from a difference between the value detected by the mixing ratio sensor and a predetermined target mixing ratio, means for judging whether or not the engine is in a transient state, means for computing a basic correction amount regarding a wall flow according to the detected value of water temperature, this wall flow being a flow of fuel along the wall of the intake passage, means for performing learning related to the wall flow correction based on the mixing ratio error detected by the mixing ratio error detection means when the engine is in the transient state, means for computing a basic correction amount regarding a wall flow of fuel flowing along the wall of the intake passage according to the detected value of water temperature, means for performing learning related to a correction of the wall flow based on the mixing ratio error detected by the mixing ratio error detection means when the engine is in the transient state, means for computing a basic correction amount regarding a wall flow of fuel flowing along the wall of the intake passage according to the detected value of water temperature, means for performing learning related to a correction of the wall flow based on the mixing ratio error detected by the mixing ratio error detection means when the engine is in the transient state, a memory for storing the transient learned value, means for searching the transient learned value in the memory when the engine re-enters the transient state, means for computing a wall flow correction amount based on the searched transient learned value and the basic correction amount of the wall flow, means for correcting the basic fuel injection amount by the computed wall flow correction amount, means for outputting the corrected injection amount to the fuel injector, means for updating the transient learned value stored in the memory such that the mixing ratio error under the transient state decreases, means for judging whether the engine is in a post-transient state, means for judging whether or not the mixing ratio error detected in the post-transient state lies within a predetermined range, and means for prohibiting updating of the transient learned values when thc post-transient error does not lie within the predetermined range.

This invention also provides an air-fuel ratio controller for a water-cooled engine comprising sensors for detecting engine load and speed, means for computing a basic fuel injection amount of the fuel injector based on the detected value of the engine load and speed, a sensor for detecting engine coolant water temperature, a sensor for detecting a real mixing ratio of the fuel and air provided in the cylinder by the fuel injector and intake passage, means for detecting a mixing ratio error from a difference between the value detected by the mixing ratio sensor and a predetermined target mixing ratio, means for judging whether or not the engine is in a transient state, means for computing a basic correction amount regarding a wall flow of fuel flowing along the wall of the intake passage according to the detected value of water temperature, means for performing learning related to a correction of the wall flow based on the mixing ratio error detected by the mixing ratio error detection means when the engine is in the transient state, a memory for storing the transient learned value, means for searching the transient learned value in the memory when the engine re-enters the transient state, means for computing a wall flow correction amount based on the searched transient learned value and the basic correction amount of the wall flow, means for correcting the basic fuel injection amount by the computed wall flow correction amount, means for outputting the corrected injection amount to the fuel injector, means for updating the transient learned value stored in the memory such that the mixing ratio error under the transient state decreases, means for judging whether the engine is in a post-transient state, means for judging whether the engine is in a pre-transient state, means for judging whether or not the difference between the mixing ratio error detected in the pre-transient state and the post-transient state, lies within a predetermined range, and means for prohibiting updating of the transient learned values when the difference does not lie within the predetermined range.

This invention also provides an air-fuel ratio controller for a water-cooled engine comprising sensors for detecting engine load and speed, means for computing a basic fuel injection amount of the fuel injector based on the detected value of the engine load and speed, means for computing a target mixing ratio at a regular time period, a sensor for detecting a real mixing ratio of the fuel and air provided in the cylinder by the fuel injector and intake passage, means for computing a feedback correction amount of the mixing ratio based on a value detected by the real mixing ratio sensor at the same time period as the target mixing ratio, means for computing a target mixing ratio damping value from the target mixing ratio and the feedback correction amount at a predetermined time period before the current point, and storing it, means for computing a difference between the stored target mixing ratio damping value and the detected real mixing ratio of the current point as a mixing ratio error, a sensor for detecting engine coolant water temperature, means for judging whether or not the engine is in a transient state, means for computing a basic correction amount regarding a wall flow of fuel flowing along the wall of the intake passage according to the detected value of water temperature, means for performing learning related to the wall flow correction based on the mixing ratio error detected by the mixing ratio error detection means when the engine is in the transient state, a memory for storing the transient learned value, means for searching the transient learned value in the memory when the engine re-enters the transient state, means for computing a wall flow correction amount based on the searched transient learned value and the basic correction amount of the wall flow, means for correcting the basic fuel injection amount by the computed wall flow correction amount, means for outputting the corrected injection amount to the fuel injector, and means for updating the transient learned value stored in the memory such that the mixing ratio error under the transient state decreases.

This invention also provides an air-fuel ratio controller for a water-cooled engine comprising sensors for detecting engine load and speed, means for computing a basic fuel injection amount of the fuel injector based on the detected value of the engine load and speed, means for computing a target mixing ratio at a regular time period, a sensor for detecting a real mixing ratio of the fuel and air provided in the cylinder by the fuel injector and intake passage, means for computing a feedback correction amount of the mixing ratio based on a value detected by the real mixing ratio sensor at the same time period as the target mixing ratio, means for computing a target mixing ratio damping value from this target mixing ratio and the feedback correction amount at a predetermined time period before the current point, and storing it, means for computing a difference between the stored target mixing ratio damping value and the detected real mixing ratio of the current point as a mixing ratio error, means for judging whether or not the engine is in a steady state, means for performing learning related to the basic fuel injection amount based on the mixing ratio error in the steady state, a memory for storing the steady state learned value, means for searching the steady state learned value in the memory when the engine re-enters the steady state, means for correcting the basic fuel injection amount by the searched steady state learned value and the feedback correction amount so as to determine a fuel injection amount in the steady state, means for outputting the injection amount to the fuel injector, and means for updating a steady state learned value stored in the memory such that the mixing ratio error in the steady state decreases.

This invention also provides an air-fuel ratio controller for a water-cooled engine comprising sensors for detecting engine load and speed, means for computing a basic fuel injection amount of the fuel injector based on the detected value of the engine load and speed, a sensor for detecting engine coolant water temperature, an $O_2$ sensor fitted in the exhaust passage and generating an output signal which varies sharply at a particular $O_2$ density in the exhaust passage corresponding to theoretical mixing ratio of fuel and air in the cylinder, means for judging whether the real mixing ratio of fuel and air provided in the cylinder is rich or lean from the output of the $O_2$ sensor, means for judging whether or not the engine is in a transient state, means for counting the time during which the real mixing ratio is rich and the time during which it is lean based on the result judged by the judging means when the engine enters the transient state, means for computing a basic correction amount regarding a wall flow according to the detected value of water temperature, this wall flow being a flow of fuel along the wall of the intake passage, means for performing learning related to the wall flow correction based on the rich time and lean time counted by the counting means when the engine is in the transient state, a memory for storing the transient learned value, means for searching the transient learned value in the memory, means for computing a wall flow correction amount based on the searched transient learned value and the basic amount of the wall flow correction, means for computing a mixing ratio feedback correction amount based on the result judged by the mixing ratio judging means, means for correcting the basic fuel injection amount by the computed feedback correction amount and the wall flow correction amount, means for outputting the corrected injection amount to the fuel injector, means for computing an excess or insufficiency in the transient learned value based on at least one of the mixing ratio feedback correction amount and the output of the $O_2$ sensor, means for updating the transient learned value stored in the memory so as to minimize the excess or insufficiency, means for determining whether or not the engine is in a pre-acceleration state, means for determining whether or not the engine is in a post-acceleration state, and means for prohibiting updating of the transient learned value when the difference between the feedback correction amounts before acceleration in the transient state, and after acceleration in the transient state, does not lie within a predetermined range.

This invention also provides an air-fuel ratio controller for an engine comprising sensors for detecting engine load and speed, means for computing a basic fuel injection amount of the fuel injector based on the detected value of the engine load and speed, a sensor for detecting engine coolant water temperature, an $O_2$ sensor fitted in the exhaust passage and generating an output signal which varies sharply at a particular $O_2$ density in the exhaust passage corresponding to theoretical mixing ratio of fuel and air in the cylinder, means for judging whether the real mixing ratio of fuel and air provided in the cylinder is rich or lean from the output of the $O_2$ sensor, means for judging whether or not the engine is in a transient state, means for counting the time during which the real mixing ratio is rich and the time during which it is lean based on the result judged by the judging means when the engine enters the transient state, means for computing a basic correction amount regarding a wall flow according to the detected value of water temperature, this wall flow being a flow of fuel along the wall of the intake passage, means for performing learning related to the wall flow correction based on the rich time and lean time counted by the counting means when the engine is in the transient state, a memory for storing the transient learned value, means for searching the transient learned value in the memory, means for computing a wall flow correction amount based on the searched transient learned value and the basic amount of the wall flow correction, means for computing a mixing ratio feedback correction amount based on the result judged by the mixing ratio judging means, means for correcting the basic fuel injection amount by the computed feedback correction amount and the wall flow correction amount, means for outputting the corrected injection amount to the fuel injector, means for computing an excess or insufficiency in the transient learned value based on at least one of the mixing ratio feedback correction amount and the output of the $O_2$ sensor, means for updating the transient learned value stored in the memory so as to minimize the excess or insufficiency, means for determining whether or not the engine is in a pre-acceleration state, means for determining whether or not the engine is in a post-acceleration state, means for quantitively comparing the feedback correction amounts before acceleration in the transient state, and after acceleration in the transient state, and means for prohibiting updating of the transient learned value when the feedback correction amount after acceleration in the transient state, is greater than the feedback correction amount before acceleration in the transient state by at least a predetermined amount, and the real mixing ratio is lean.

This invention also provides an air-fuel ratio controller for an engine comprising sensors for detecting engine load and speed means for computing a basic fuel injection amount of the fuel injector based on the detected value of the engine load and speed, a sensor for detecting engine coolant water temperature, an $O_2$ sensor fitted in the exhaust passage and generating an output signal which varies sharply at a particular $O_2$ density in the exhaust passage corresponding to theoretical mixing ratio of fuel and air in the cylinder, means for judging whether the real mixing ratio of fuel and air provided in the cylinder is rich or lean from the output of the $O_2$ sensor, means for judging whether or not the engine is in a transient state, means for counting the time during which the real mixing ratio is rich and the time during which it is lean based on the result judged by the judging means when the engine enters the transient state, means for computing a basic correction amount regarding a wall flow according to the detected value of water temperature, this wall flow being a flow of fuel along the wall of the intake passage, means for performing learning related to the wall flow correction based on the rich time and lean time counted by the counting means when the engine is in the transient state, a memory for storing the transient learned value, means for searching the transient learned value in the memory, means for computing a wall flow correction amount based on the searched transient learned value and the basic amount of the wall flow correction, means for computing a mixing ratio feedback correction amount based on the result judged by the mixing ratio judging means, means for correcting the basic fuel injection amount by the computed feedback correction amount and the wall flow correction amount, means for outputting the corrected injection amount to the fuel injector, means for computing an excess or insufficiency in the transient learned value based on at least one of the mixing ratio feedback correction amount and the output of the $O_2$ sensor, means for updating the transient learned value stored in the memory so as to minimize the excess or insufficiency, means for determining whether or not the engine is in a pre-acceleration state, means for determining whether or not the engine is in a post-acceleration state, means for quantitively comparing the feedback correction amounts before acceleration in the transient state, and after acceleration in the transient state, and means for prohibiting updating of the transient learned value when the feedback correction amount after acceleration in the transient state, is greater than the feedback correction amount before acceleration in the transient state by at least a predetermined amount, and the real mixing ratio is rich.

This invention also provides an air-fuel ratio controller for an engine comprising sensors for detecting engine load and speed, means for computing a basic fuel injection amount of the fuel injector based on the detected value of the engine load and speed, a sensor for detecting engine coolant water temperature, an $O_2$ sensor fitted in the exhaust passage and generating an output signal which varies sharply at a particular $O_2$ density in the exhaust passage corresponding to theoretical mixing ratio of fuel and air in the cylinder, means for judging whether the real mixing ratio of fuel and air provided in the cylinder is rich or lean from the output of the $O_2$ sensor, means for judging whether or not the engine is in a transient state, means for counting the time during which the real mixing ratio is rich and the time during which it is lean based on the result judged by the judging means when the engine enters the transient state, means for computing a basic correction amount regarding a wall flow according to the detected value of water temperature, this wall flow being a flow of fuel along the wall of the intake passage, means for performing learning related to the wall flow correction based on the rich time and lean time counted by the counting means when the engine is in the transient state, a memory for storing the transient learned value, means for searching the transient learned value in the memory, means for computing a wall flow correction amount based on the searched transient learned value and the basic amount of the wall flow correction, means for computing a mixing ratio feedback correction amount based on the result judged by the mixing ratio judging means, means for correcting the basic fuel injection amount by the computed feedback correction amount and the wall flow correction amount, means for outputting the corrected injection amount to the fuel injector, means for updating the transient learned value stored in the memory so as to minimize the difference between the rich time and the lean time counted by the counting means, and means for prohibiting counting of the lean time by the counting means when the real mixing ratio judged by the mixing ratio judging means is lean, and the computed feedback correction amount is smaller than a predetermined amount.

This invention also provides an air-fuel ratio controller for an engine comprising sensors for detecting engine load and speed, means for computing a basic fuel injection amount of the fuel injector based on the detected value of the engine load and speed, a sensor for detecting engine coolant water temperature, an $O_2$ sensor fitted in the exhaust passage and generating an output signal which varies sharply at a particular $O_2$ density in the exhaust passage corresponding to theoretical mixing ratio of fuel and air in the cylinder, means for judging whether the real mixing ratio of fuel and air provided in the cylinder is rich or lean from the output of the $O_2$ sensor, means for judging whether or not the engine is in a transient state, means for counting the time during which the real mixing ratio is rich and the time during which it is lean based on the result judged by the judging means when the engine enters the transient state, means for computing a basic correction amount regarding a wall flow according to the detected value of water temperature, this wall flow being a flow of fuel along the wall of the intake passage, means for performing learning related to the wall flow correction based on the rich time and lean time counted by the counting means when the engine is in the transient state, a memory for storing the transient learned value, means for searching the transient learned value in the memory, means for computing a wall flow correction amount based on the searched transient learned value and the basic amount of the wall flow correction, means for computing a mixing ratio feedback correction amount based on the result judged by the mixing ratio judging means, means for correcting the basic fuel injection amount by the computed feedback correction amount and the wall flow correction amount, means for outputting the corrected injection amount to the fuel injector, means for updating the transient learned value stored in the memory so as to minimize the difference between the rich time and the lean time counted by the counting means, and means for prohibiting counting of the rich time by the counting means when the real mixing ratio judged by the mixing ratio judging means is rich, and the computed feedback correction amount is greater than a predetermined amount.

This invention also provides an air-fuel ratio controller for an engine comprising sensors for detecting engine load and speed, means for computing a basic fuel injection amount of the fuel injector based on the detected value of the engine load and speed, a sensor for detecting engine coolant water temperature, an $O_2$ sensor fitted in the exhaust passage and generating an output signal which varies sharply at a particular $O_2$ density in the exhaust passage corresponding to theoretical mixing ratio of fuel and air in the cylinder, means for judging whether the real mixing ratio of fuel and air provided in the cylinder is rich or lean from the output of the $O_2$ sensor, means for judging whether or not the engine is in a transient state, means for counting the time during which the real mixing ratio is rich and the time during which it is lean based on the result judged by the judging means when the engine enters the transient state, means for computing a basic correction amount regarding a wall flow according to the detected value of water temperature, this wall flow being a flow of fuel along the wall of the intake passage, means for performing learning related to the wall flow correction based on the rich time and lean time counted by the counting means when the engine is in the transient state, a memory for storing the transient learned value, means for searching the transient learned value in the memory, means for computing a wall flow correction amount based on the searched transient learned value and the basic amount of the wall flow correction, means for computing a mixing ratio feedback correction amount based on the result judged by the mixing ratio judging means, means for correcting the basic fuel injection amount by the computed feedback correction amount and the wall flow correction amount, means for outputting the corrected injection amount to the fuel injector, means for updating the transient learned value stored in the memory so as to minimize the difference between the rich time and the lean time counted by the counting means, means for determining whether or not the engine is in a pre-acceleration state, and means for prohibiting counting of the lean time by the counting means when the real mixing ratio judged by the mixing ratio judging means is lean, and the difference between the feedback correction amounts when the engine is in the pre-acceleration state in the transient state, and during acceleration, is equal to or less than a predetermined value.

This invention also provides an air-fuel ratio controller for an engine comprising comprising: sensors for detecting engine load and speed, means for computing a basic fuel injection amount of the fuel injector based on the detected value of the engine load and speed, a sensor for detecting engine coolant water temperature, an $O_2$ sensor fitted in the exhaust passage and generating an output signal which varies sharply at a particular $O_2$ density in the exhaust passage corresponding to theoretical mixing ratio of fuel and air in the cylinder, means for judging whether the real mixing ratio of fuel and air provided in the cylinder is rich or lean from the output of the $O_2$ sensor, means for judging whether or not the engine is in a transient state, means for counting the time during which the real mixing ratio is rich and the time during which it is lean based on the result judged by the judging means when the engine enters the transient state, means for computing a basic correction amount regarding a wall flow according to the detected value of water temperature, this wall flow being a flow of fuel along the wall of the intake passage, means for performing learning related to the wall flow correction based on the rich time and lean time counted by the counting means when the engine is in the transient state, a memory for storing the transient learned value, means for searching the transient learned value in the memory, means for computing a wall flow correction amount based on the searched transient learned value and the basic amount of the wall flow correction, means for computing a mixing ratio feedback correction amount based on the result judged by the mixing ratio judging means, means for correcting the basic fuel injection amount by the computed feedback correction amount and the wall flow correction amount, means for outputting the corrected injection amount to the fuel injector, means for updating the transient learned value stored in the memory so as to minimize the difference between the rich time and the lean time counted by the counting means, means for determining whether or not the engine is in a pre-acceleration state, and means for prohibiting counting of the rich time by the counting means when the real mixing ratio judged by the mixing ratio judging means is rich, and the difference between the feedback correction amounts when the engine is in the pre-acceleration state in the transient state, and during acceleration, is equal to or less than a predetermined value.

DESCRIPTION OF THE PREFERRED EMBODIMENTS

FIGS. 1-31 illustrate a first embodiment of this invention.

Figure 1:
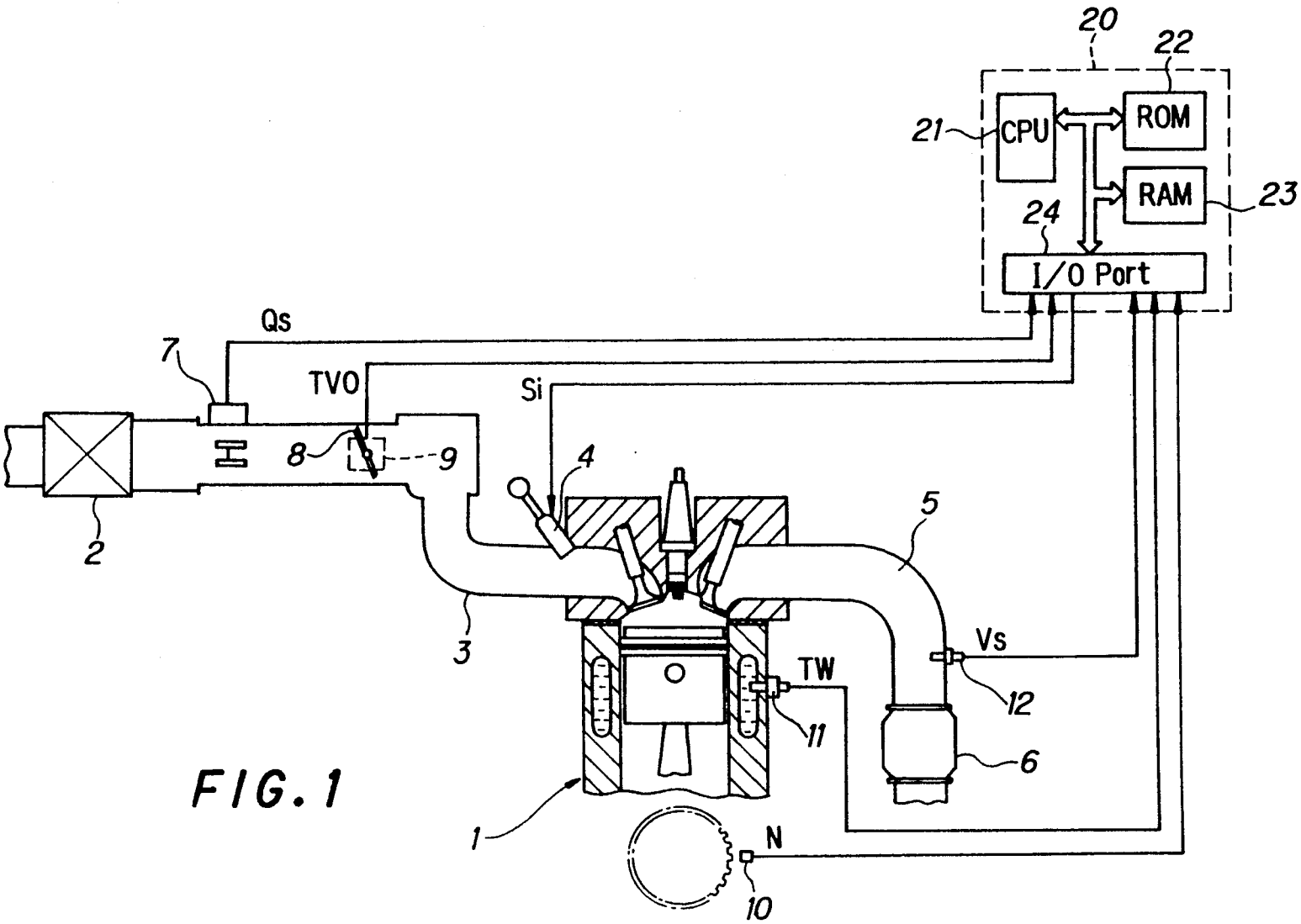
FIG. 1 is a schematic diagram illustrating a first embodiment of this invention.

In FIG. 1, intake air passes from an air cleaner 2 via an intake passage 3, and fuel is injected into each intake port of an engine 1 from a fuel injector 4 provided in each cylinder based on an injection signal Si. Gas which has been burnt in the cylinder is led via an exhaust passage 5 into a catalystic converter 6 where toxic components of the burnt gas (CO, HC and NOx) are treated by a three-way catalyzer and expelled.

The flowrate Qs of intake air is detected by a hot wire type air flow meter 7, and controlled by a throttle valve 8 operating in synchronism with the accelerator pedal.

The opening TVO of the throttle valve 8 is detected by a throttle opening sensor 9, and the engine speed N of the engine 1 is detected by a crank angle sensor 10. Further, the cooling water temperature TW of a water jacket is detected by a water temperature sensor 11, and the AFR of the gas provided in the cylinder is detected by an AFR sensor 12 which is fitted in the exhaust passage 5. The AFR sensor 12 has the ability to detect a wide range of air-fuel ratios varying from rich to lean.

The outputs of the aforesaid air flow meter 7, throttle opening sensor 9, crank angle sensor 10 and water temperature sensor 12 are input to a control unit 20 consisting of a microprocessor.

The control unit 20 controls the AFR of the gas entering the cylinder as shown in FIGS. 2-9.

In this embodiment, fuel injection is performed for each cylinder in turn, i.e. sequentially. When the engine is running at constant speed or accelerating slowly, the fuel injection is synchronized with the crankshaft angular position. During rapid acceleration, however, an asynchronous injection is performed in a short time interval independently of the crankshaft angular position. The amount of fuel injected is determined for each cylinder based on the air volume aspirated into the cylinder following the immediately preceding injection. Further, due to wall flow of fuel produced by an asynchronous injection, the AFR in a synchronous injection following an asynchronous injection is temporarily richer, so the AFR has to be adjusted to correct for this.

Here, the control system will be outlined briefly using the flowcharts of FIGS. 7a, 7b, 8 and 9, and the transient learning control shown in FIGS. 2-6 will then be described.

Figure 7A:
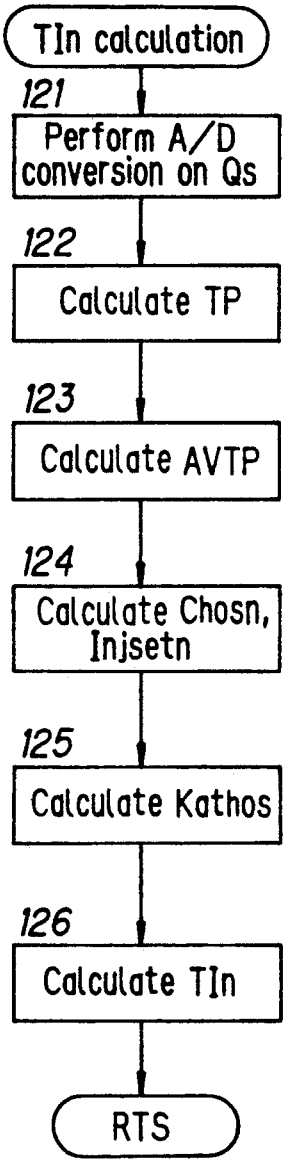

FIG. 7a is a routine for determining the synchronous pulse width TIn [ms] for each cylinder. Since the routines of FIGS. 7a, 7b and 8 determine the synchronous and asynchronous injection pulse width for different cylinders, a number n is added to the end of symbols referring to a particular cylinder (e.g. AVTPn, Tin, Chosn and Injsetn).

In a step 122, a basic injection pulse width Tp [ms] is determined by the intake flowrate Qs [g/s] and the engine speed N [rpm]:

$$Tp=(Qs/N)\times K\times Ktrm \quad (1)$$

where K is a coefficient to determine a basic mixing ratio, Ktrm is a correction coefficient to correct the air flow volume and injector error for each set of engine conditions, and trm designates the word "trimming".

From this basic injection pulse width Tp a pulse width corresponding to air volume AVTP [ms], which represents a fuel injection quantity corresponding to the aforesaid cylinder intake air volume, can be found from the following relation (step 123):

$$\text{AVTP}=Tp\times F\,\text{load}+\text{Old AVTP}\times(1-F\,\text{load}) \quad (2).$$

In equation (2), F load is an average weighting coefficient (%) which is found from the product of engine speed N and cylinder volume V [cc], N×V, and the overall flowpath area Aa [cm²], by referring to a map. The word "Old" in the expression "Old AVTP" signifies the value of AVTP on the immediately preceding occasion, and it has the same meaning in the case of other symbols hereinafter described.

In a step 125, a transient correction value Kathos [ms] related to fuel wall flow is computed (to be described hereinafter), and finally, a synchronous injection pulse TIn [ms] per cylinder is determined by the following equation (step 126):

$$TIn = (AVTP + Kathos) \times TMR \times (\alpha + \alpha m) + Chosn - Erascin + Ts \quad (3)$$

where:

TMR = Target mixing ratio [dimensionless]

$\alpha$ = AFR feedback correction coefficient based on output of AFR sensor 12 [dimensionless]

$\alpha m$ = Correction coefficient obtained by AFR learning [ms]

Chosn = Correction value specific to the cylinder [ms]

Erascin = Over-injection correction value specific to the cylinder [ms]

Ts = Ineffectual pulse width [ms].

Figure 7B:
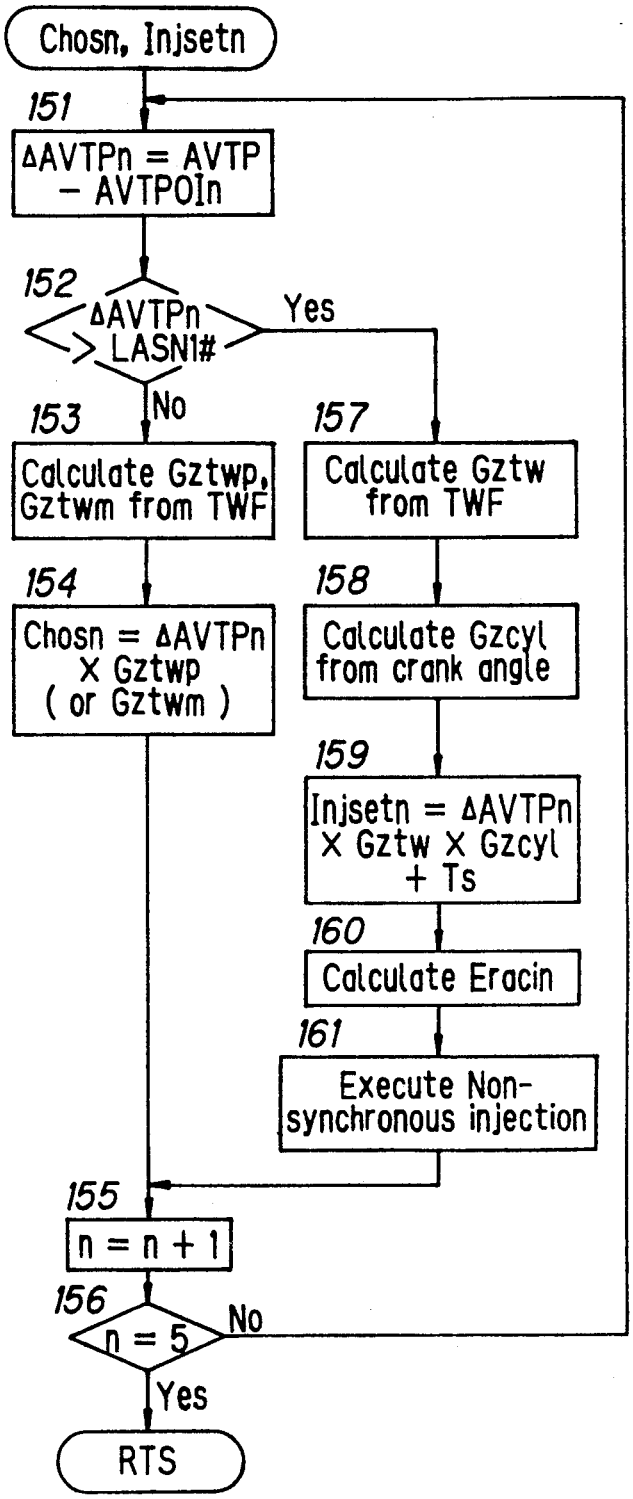
Figure 19:
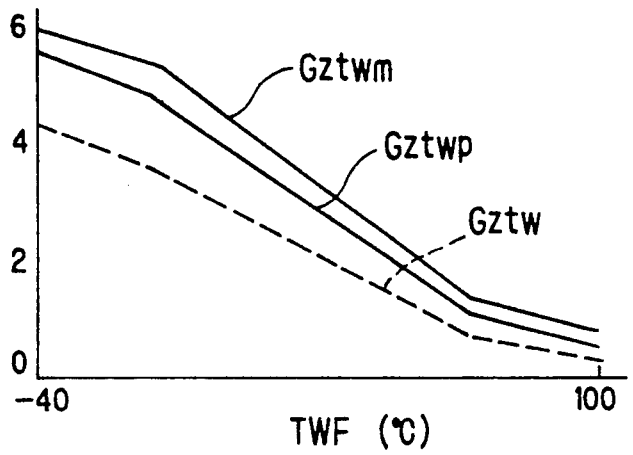
FIG. 19 is a graphical representation of Gztwp, Gzwtm and Gztw tables used in the first embodiment of this invention.

The correction value Chosn and over-injection correction value Erascin are calculated, together with the asynchronous injection amount per cylinder Injsetn [ms], by the following equations in a step 124 in FIG. 7*b*:

$$Chosn = \Delta AVTPn \times Gzwtp \text{ (Gztwm for deceleration)}$$

$$Injsetn = \Delta AVTPn \times Gztw \times Gzcyl + Ts$$

$$Erascin = Old\ Erascin + \Delta AVTPn \times Gztw \times (Gzcyl - ERACP)$$

where Gztwp is the increase gain, Gztwm is the decrease gain and Gztw is the asynchronous gain, these data being shown in FIG. 19 and determined according to the cylinder. Gzcyl is a correction gain due to asynchronous injection timing, and ERACP is a reference value to calculate the current overinjection amount.

Figure 8:
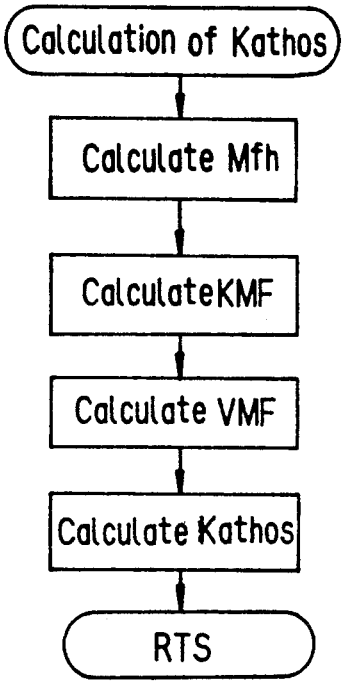
Figure 9:
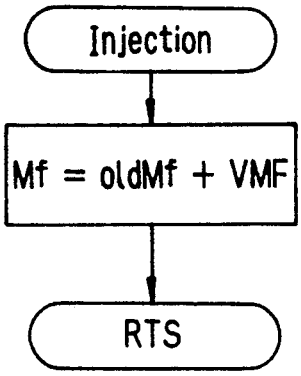

FIG. 8 is a routine to compute the transient correction value Kathos, this routine being executed once every 10 msec. Kathos is a correction for wall liquid flow by storing a deposition amount. The flow of liquid flow along the wall varies relatively slowly in transient condition. It can therefore be obtained by storing an equilibrium deposition amount Mfh depending on the engine running conditions, and assigning it in suitable proportions for each fuel injection as a general correction.

First, the steady state deposition amount Mfh [ms] of the wall flow in the intake passage 3, is calculated by the following relation (step 131):

$$Mfh = AVTP \times Mfhqt \times MfhN.$$

Here, it is assumed that the steady state deposition amount Mfh is a linear function of the pulse width AVTP corresponding to the cylinder air volume, the proportionality constant being Mfhqt. Specifically, this constant Mfhqt is a deposition factor found by interpolation with reference to a predetermined map from a temperature prediction value TWF [°C.] and N−TVO flowrate $Qh_O$ [%].

The temperature prediction value TWF is introduced as a value for predicting the temperature of a region where fuel is deposited. The temperature of a region where fuel is deposited (e.g. an intake valve) differs from the cooling water temperature TW due to fuel cut, start-up or the orientation of the injector. This difference causes the steady state deposition amount Mfh to vary, which leads to a shift of the transient AFR. The temperature prediction value TWF is therefore used instead of the cooling water temperature TW to avoid this shift occurring.

$Qh_O$ is the air flow rate of the throttle valve found from the throttle valve opening TVO and the engine speed N, and it is an already known quantity.

$Mfh_N$ is a correction rate for the deposition factor, which is found by interpolation with reference to a predetermined map base on the engine speed N.

If the adhesion amount at any current time is Mf [ms], Mfh−Mf could then be interpreted as the part of the wall flow in to acceleration. By introducing a rate of variation of deposition KMF [%], a wall flow variation per injection VMF [ms] is calculated by the following relation (step 133):

$$VMF = (Mfh - Mf) \times KMF \quad (4).$$

The wall flow increases by an amount VMF due to the present injection, so the adhesion amount Mf for the current injection may be obtained from the following relation (FIG. 9):

$$Mf = Old\ Mf + VMF \quad (5).$$

The deposition proportion KMF of equation (4) is obtained from the following relation (step 132):

$$KMf = KMFat \times KMF_N$$

where, KMFat [%] is a basic deposition proportion which is determined by interpolation with reference to a predetermined map from the cooling water temperature TW and the N−TVO flowrate Qh. KMFN [%] is an engine speed correction determined by interpolation with reference to a predetermined map from the engine speed N.

The transient correction value Kathos [ms] is then obtained from the deposition rate VMF using the following relation (step 134), and the routine is terminated:

$$Kathos = VMF \times Ghf$$

where, Ghf is a [%] correction to prevent overlean during deceleration using light fuel. During acceleration, Kathos = VMF.

The above completes this brief description of the transient control system.

Figure 15:
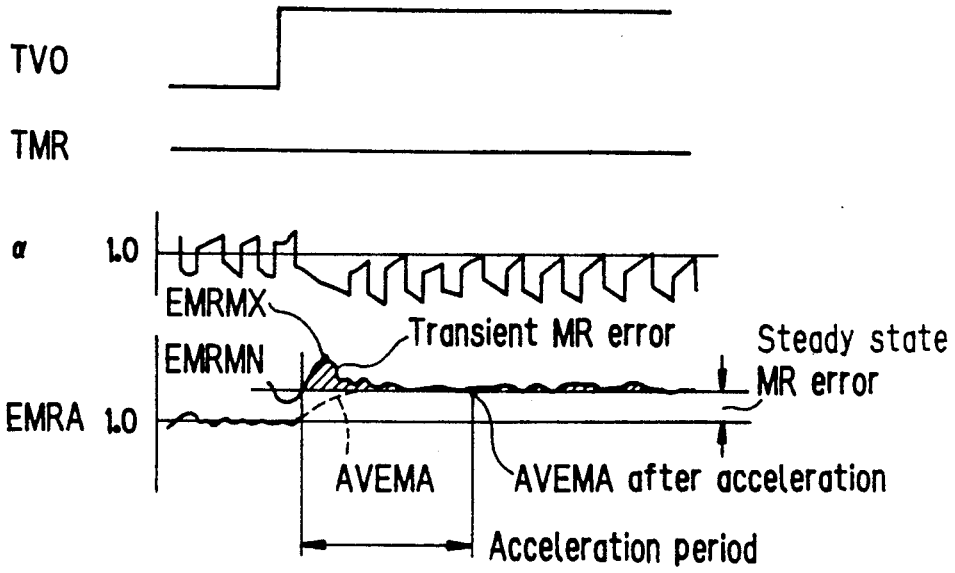
FIGS. 15 and 16 are both timing charts showing transient errors of AFR occurring in an acceleration of a vehicle.

FIG. 15 shows the variation of the mixing ratio error (the value obtained by subtracting the target mixing ratio from the real mixing ratio) during acceleration. It can be seen from this example that after the transient period has elapsed, a large standing error remains. In the figure, TMR is a target mixing ratio and EMRA is a mixing ratio error, both of which will be described hereinafter.

Figure 16:
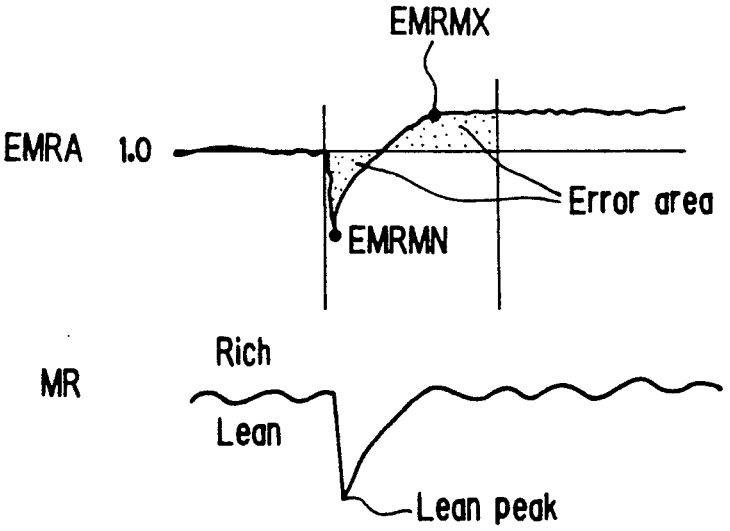

In this case, if transient learning is performed by "area learning" in an acceleration period determined (sampling period) such that error areas above and under EMRA = 1 are the same and the total error area is zero as shown in the upper part of FIG. 16, the real mixing ratio MR in the sampling period will be controlled as shown in the lower part of FIG. 16. If there is a lean peak in the sampling period as shown in this figure, therefore, the engine hesitates and stumbles, driving performance is adversely affected, and exhaust gas quality is impaired (e.g. CO increases).

In this invention, therefore, transient learned values are updated based on the difference between the mixing ratio errors during the acceleration period and when it is finished. Ratios may be used instead of differences. These operations are implemented in the flowcharts of FIG. 2–FIG. 6.

Figure 2A:
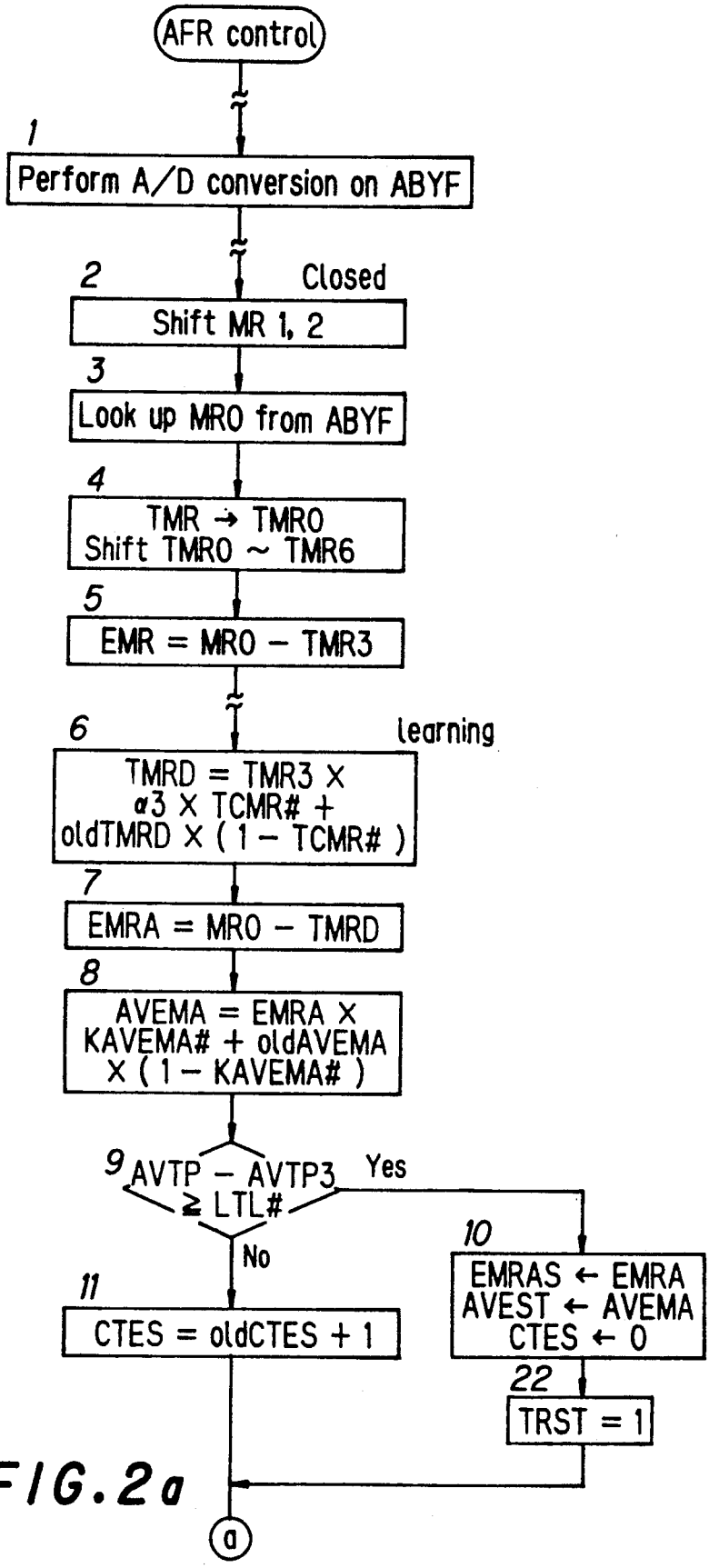
FIGS. 2*a*–9 are flowcharts describing various control actions performed in the first embodiment of this invention.
Figure 2B:
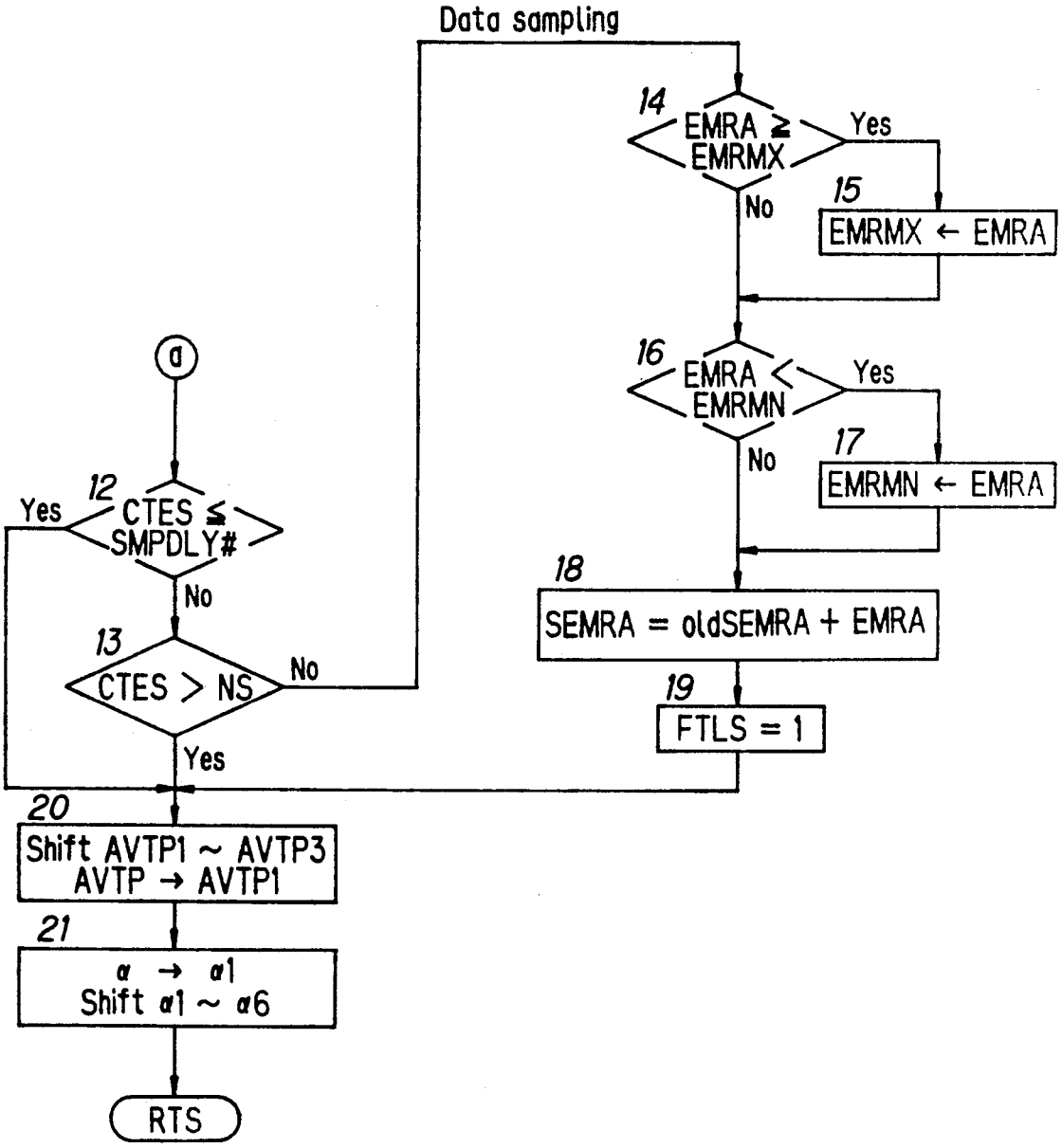

FIG. 2 is a routine for controlling the AFR, and it is executed at every 240° turn of the crankshaft.

Figure 10:
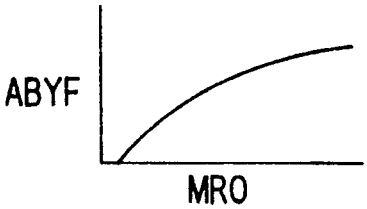
FIG. 10 is a graphical representation of contents of an MRO table used in the first embodiment of this invention.

After performing A/D conversion on the AFR output sensor output ABYF, the latter is converted to a real mixing ratio MRO using a mixing ratio table (MRO table) (step 3), and the current real mixing ratio is entered into an RAM MR0. FIG. 10 is a graphical representation of the contents of the MR0 table.

The two immediately preceding real mixing ratios MR1 and MR2 are entered into separate RAMs, and in a step 2, the values in MR0 and MR1 are respectively shifted to MR1 and MR2. Here, the numerals [0], [1] and [2] after MR refer to the current value, immediately preceding value and the value before that. These numerals are also used in the case of other symbols.

Regarding the target mixing ratios, RAMs are provided for storing values from 6 preceding values up to the current value (TMR0–TMR6). In a step 4, the values in TMR0–TMR5 are all shifted to TMR1–TMR6, and the current target mixing ratio is entered in TMR0. These target mixing ratios are determined with reference to a map from the cooling water temperature TW, the pulse width AVTP corresponding to the cylinder air volume, and the engine speed N.

The mixing ratio errors EMR is then given by the difference between a target mixing ratio and a real mixing ratio:

z $$EMR = MRO - TMR3 \quad (6)$$

The reason why the third preceding target mixing ratio TMR3 is used for the current real mixing ratio MRO, is because there is a time delay before the fuel injected from the air intake port reaches the AFR sensor installed in the exhaust passage, and an allowance must be made for this. In a step 21, based on this EMR, the AFR feedback correction coefficient $\alpha$ is computed.

However, in the case of acceleration, another mixing ratio error EMRA for acceleration (described hereinafter) which takes account of the magnitude of $\alpha$ is used instead of this mixing ratio error EMR.

A target mixing ratio damped value TMRD (equivalent to the target mixing ratio during acceleration) is found from the product of the target mixing ratio TMR and the AFR feedback correction coefficient $\alpha$ using the following relation (step 6):

$$TMRD = (TMR3 \times \alpha 3) \times TCMR\# + \text{old } TMRD \times (1 - TCMR\#) \quad (7).$$

The reason why the third preceding value is used in the case of both the target mixing ratio and the AFR feedback coefficient, is to allow for fuel delay, exhaust gas response time and sensor response time. TCMR# is a damping constant obtained by monitoring the fuel wall flow and sensor response, and by applying this constant the variation of (TMR3$\times\alpha$3) is smoothed out. Further, if this damping constant TCMR# is made a temperature-dependent value as described hereinafter, precision can be increased.

Next, a mixing ratio error EMRA is found by using the difference between the current real mixing ratio MRO and target mixing ratio damped value TMRD for transient learning (step 7):

$$EMRA = MRO - TMRD \quad (8).$$

An average value AVEMA of this mixing ratio error EMRA is found from the following relation:

$$AVEMA \times EMRA \times KAVEMA\# + \text{old } AVEMA \times (1 - KAVEMA\#) \quad (9)$$

where, KAVEMA# is an averaging constant.

Average value is used to avoid the effect of fluctuation of the real mixing ratio MRO due to the effect of exhaust pulsations and HC, etc.

In a step 9, (AVTP−AVTP3) is compared to a transient learning judgment level (constant) LTL#. If (AVTP−AVTP3)≧LTL, the vehicle is judged to be accelerating and the program proceeds to a step 10. The mixing ratio error EMRA at that point is then entered in an RAM EMRAS, and the mixing ratio error average AVEMA at that point is entered in an RAM AVEST (step 10). In other words, the value of the mixing ratio error EMRA immediately before acceleration is entered in EMRAS, while the average mixing ratio error AVEMA immediately before acceleration is entered in AVEST.

In step 9, AVTP refers to the injection pulse width corresponding to the cylinder air volume, while AVTP3 refers to the third preceding value of same.

If the engine is not accelerating, a count value CTES of a data sampling number is increased by the following equation (step 11). This CTES has an upper limit:

$$CTES = \text{old } CTES + 1.$$

In a step 12, the count value CTES and a sampling delay constant SMPDLY# are compared, and when CTES>SMPDLY#, the program proceeds to the data sampling of step 14 and later steps. The sampling delay constant SMPDLY# corresponds to the delay of entering data from the variation of AVTP.

In data sampling, the mixing ratio error EMRA during sampling is compared to values in the RAM's EMRMX and EMRMN. If EMRA≧EMRMX, the mixing ratio error is entered in EMRMX, while if EMRA<EMRMN, the mixing ratio error is entered in EMRMN (steps 14–17). In other words, the maximum value of the mixing ratio error is held in EMRMX, while the minimum value of the mixing ratio error is held in EMRMN.

Further, the mixing ratio error is also accumulated by the following equation so as to find a mixing ratio error area SEMRA (step 18):

$$SEMRA = \text{old } SEMRA + EMRA \quad (10).$$

During data sampling, two flags (TRST and FTLS) are set (steps 19, 22). However, whereas TRST is set only at the beginning of entering learning data, (steps 45, 46 in FIG. 4), FTLS is permanently set throughout transient learning (step 77 in FIG. 4).

When the count value CTES exceeds the sampling number NS (step 13), data sampling is terminated. Transfer of the data in the RAM's then takes place (step 20, 21). First, the values in AVTP1 and AVTP2 are transferred respectively to AVTP2 and AVTP3, while the current AVTP is entered in AVTP1. Then the values in $\alpha 1$–$\alpha 5$ are shifted to $\alpha 2$–$\alpha 6$, and the current value of $\alpha$ is entered in $\alpha 1$.

Figure 4A:
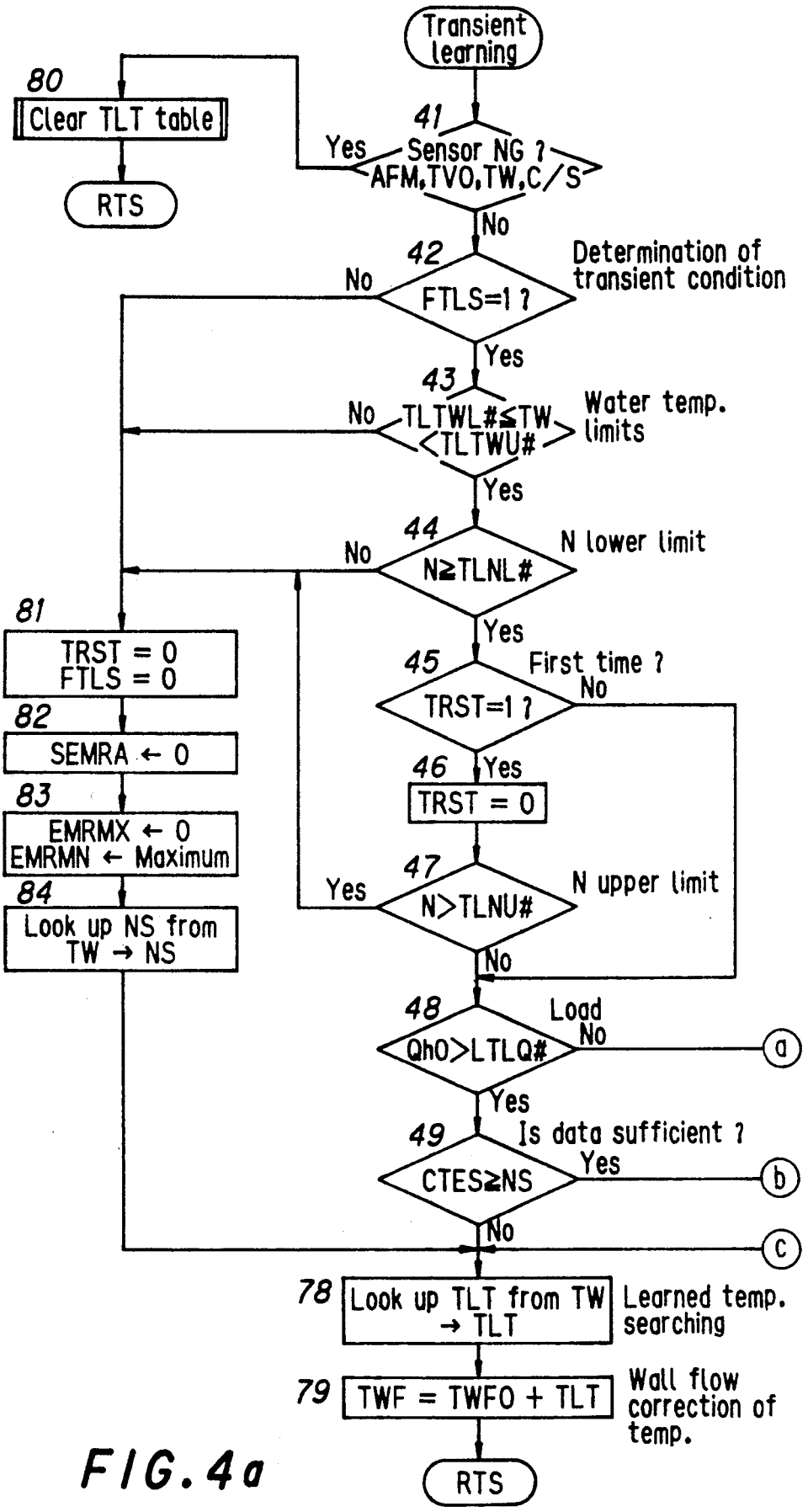
Figure 4B:
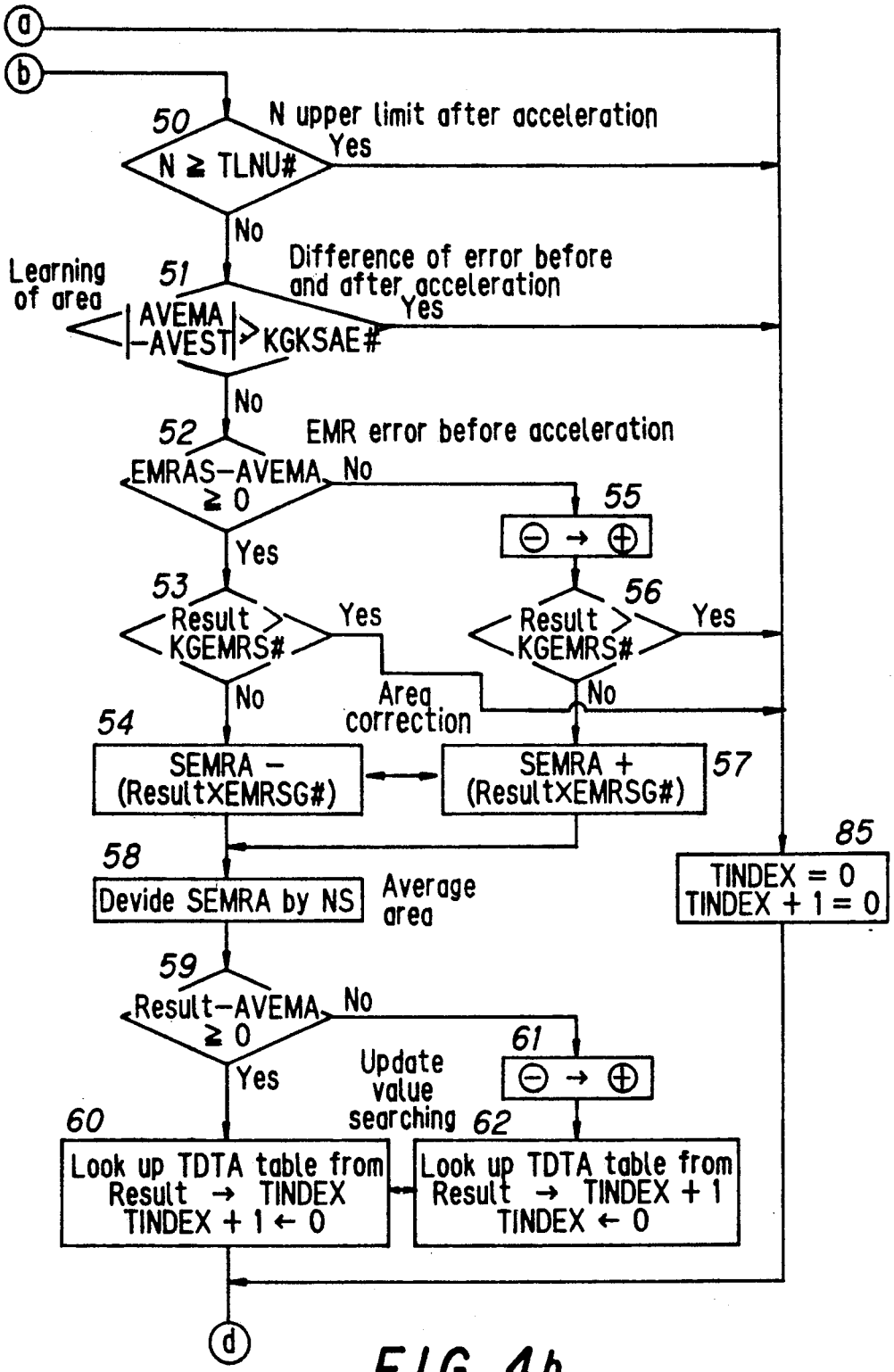
Figure 4C:
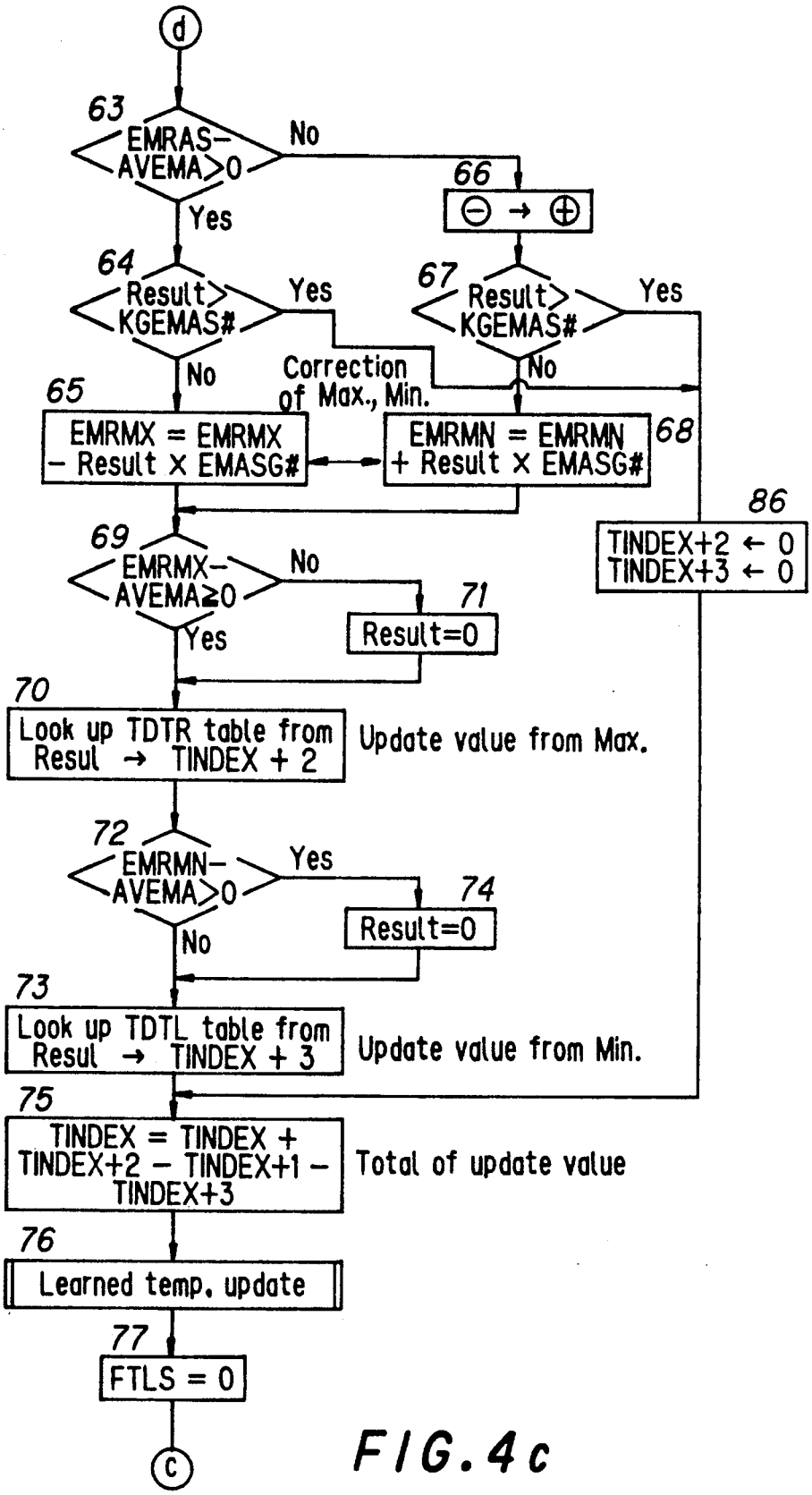

FIG. 4 shows a routine for the updating of transient learned values which is performed at fixed intervals by a background job.

Figure 3:
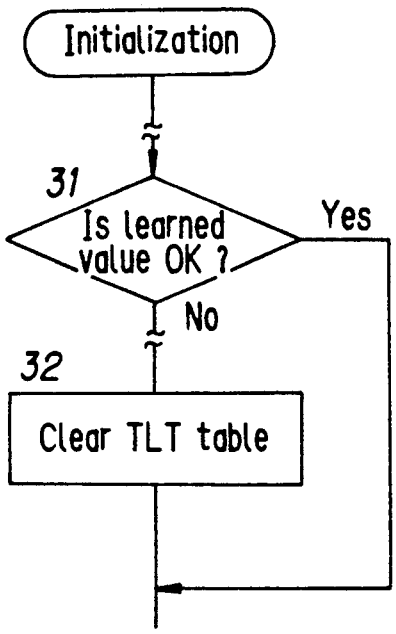

First, steps 41, 80 are failsafe steps wherein a test is made to see whether there are any malfunctions (NG) of the sensors involved in transient learning (e.g. the air flow sensor, throttle opening sensor, water temperature sensor and crank angle sensor, etc.). If there are, a TLT table stored in a back-up RAM is cleared. TLT is a transient learned temperature (described in detail hereinafter) which is assigned to the water temperature TW. This table is also cleared if a learned value is not normal (OK) in the initialization routine (FIG. 3).

Steps 42–50 are intended to determine the conditions for updating learned values. The program proceeds to update the learned values in a step 51 and later steps if the following six conditions are satisfied:

(i) FTLS=1, i.e. the program is in the transient learning stage (step 42).

(ii) The water temperature TW lies within a predetermined range (TLTWL#≦TW<TLTWU#) (step 43). For example the transient learned lower limit of water temperature (constant) TLTWL# is set at 20° C., the upper limit of water temperature (constant) TLTWU# is set at 85° C.).

(iii) The engine speed N lies within a predetermined range (TLNL#≦N≦TLNU#) (steps 44, 47). For example the transient learned lower limit of engine speed (constant) TLNL# is set at 1000 rpm, the upper limit of engine speed (constant) TLNU# is set at 3000 rpm. Learning is not performed at higher engine speeds (N>TLNU#) as the amount of wall flow fuel is small in this region.

(iv) The engine load is above a predetermined value (Qh>LTLQ#) (step 48). Here, LTLQ# is the transient learned lower limit of load (constant). The purpose of this is for example to stop learning when the accelerator pedal depression is decreased.

(v) All data sampling has been completed (step 49). The sampling number NS is obtained by reference to an NS table (step 84). According to the characteristics of the table, NS is increased for lower temperature as the effect of fuel wall flow then lasts longer.

(vi) The engine speed N does not exceed the aforesaid upper speed limit TLNU# even after the sampling period has elapsed (step 50).

If all the above conditions are satisfied, learning of the mixing ratio error area, and of the maximum and minimum values of the mixing error ratio, is performed sequentially.

AVEMA in the step 51 is a value after a sampling period (NS×Δt, where Δt is a computation period) has elapsed, i.e. a value immediately after acceleration. If the difference in the average mixing ratio error |AVEMA−AVESTA| exceeds a predetermined value KGKSAE#, then transient learning is not performed (steps 51, 85). This is because, if the difference before and after acceleration is large, the mixing ratio error is probably large under constant speed conditions, and if transient learning is applied to such case, the learning precision will fall.

To calculate updated learned values (also updated learned maximum and minimum mixing ratio errors described hereinafter), the average AVEMA of the mixing ratio error after the sampling time has elapsed (immediately after acceleration) is taken as a reference. In this case, two magnitude conditions arise between the average value AVEMA and the mixing ratio error EMRAS immediately before acceleration, so EMRAS is compared to AVEMA in order to distinguish them (step 52).

Figure 17:
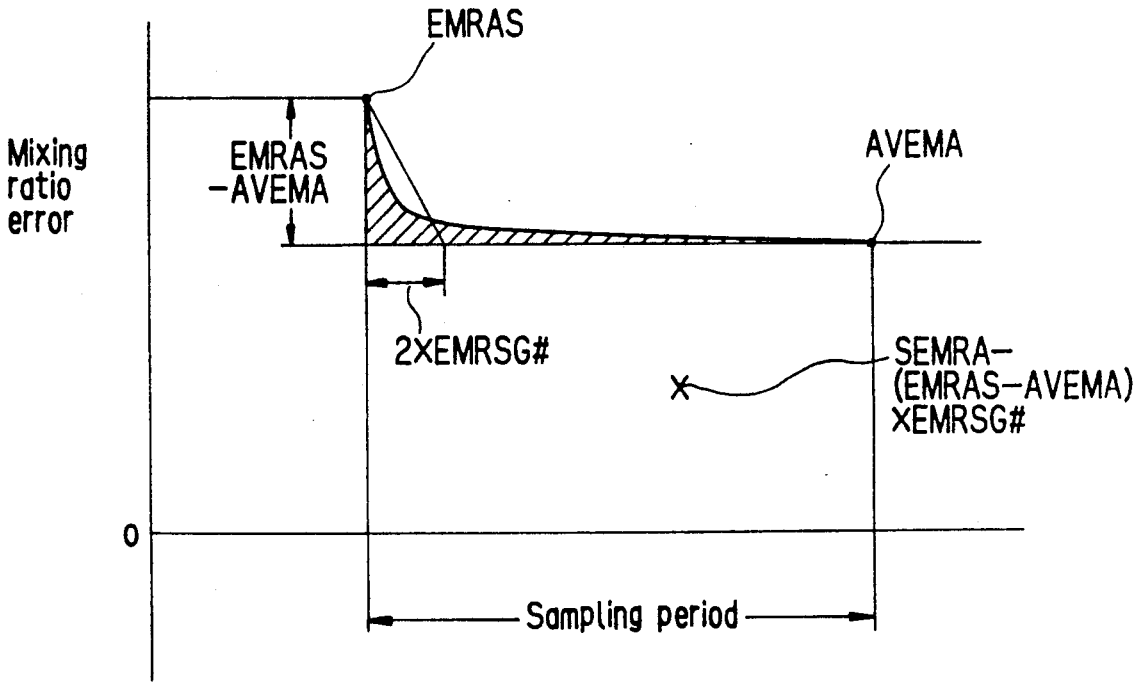
FIGS. 17 and 18 are waveform patterns describing respectively an error area correction and an error minimum value correction in the first embodiment of this invention.

If the variation of mixing ratio error in the case EMRAS>AVEMA is represented by a simple model (wherein a lean or rich peak is not considered) as shown in FIG. 17, the mixing ratio error SEMRA may be taken as the area excepting the upper shaded part of the figure. The shaded part varies due to differences of acceleration conditions, and if this part is also incorporated as an error area, learning precision is adversely affected.

Approximating the shaded area by an equilateral triangle, the height of the triangle is (EMRAS−AVEMA). If the base side is 2×EMRSG, the area of the triangle is given by (EMRAS−AVEMA)×EMRSG#.

The mixing error ratio area SEMRA in the sampling period is then corrected by the following equation (step 54):

$$\text{SEMRA}=\text{SEMRA}-(\text{EMRAS}-\text{AVEMA})\times\text{EMRSG\#} \quad (11)$$

wherein EMRSG# is an area correction gain (constant).

If on the other hand, EMRAS<AVEMA, SEMRA obeys the following relation:

$$\text{SEMRA}=\text{SEMRA}+|\text{EMRAS}-\text{AVEMA}|\times\text{EMRSG\#} \quad (12).$$

If the difference between the mixing ratio error EMRAS before acceleration and the average value of same AVEMA after acceleration, is too great (|EMRAS−AVEMA|>KGEMRS#, where KGEMRS# is a constant), area learning is not performed (steps 53, 56, 85).

If the mixing ratio error area SEMRA is then divided by the sampling number NS (step 58), the result (SEMRA/NS) corresponds to the height of the mixing ratio error area.

Comparing this height (SEMRA/NS) with AVEMA (step 59) and assuming that (SEMRA/NS≧AVEMA), an updated learned value of the mixing ratio error area is found from the difference (SEMRA/NS−AVEMA) by reference to the TDTA table, and is entered in a work RAM TINDEX [°C.] (step 60). In the same way, if (SEMRA/NS≦AVEMA), an updated learned value found by reference to the same table is entered in another work RAM TINDEX [°C.] (steps 61, 62). The reason why separate RAM's are used is that the learning correction may apply in different directions.

The work RAM which is not required is therefore set to 0 (steps 60, 62).

Figure 11:
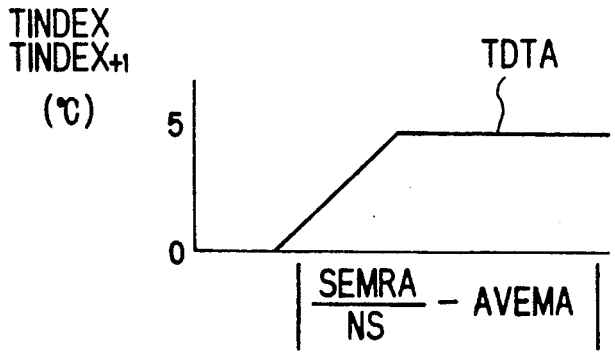
FIG. 11 is a graphical representation of contents of a TDTA table used in the first embodiment of this invention.

FIG. 11 is a graphical representation of the contents of the aforesaid TDTA table. From this figure, the updated value is set to 0 when the difference SEMRA/NS−AVEMA is small, and is set to a constant when the difference is large. In both cases, this is to stabilize the learned value.

The computation of updated value regarding maximum and minimum mixing ratio errors is basically the same as that of the error area. When EMRAS>AVEMA, the maximum value EMRMX of the mixing ratio error in the sampling interval is corrected by the following relation (steps 63, 65):

$$EMRMX = EMRMX - (EMRAS - AVEMA) \times EMASG\# \quad (13).$$

When on the other hand EMRAS≦AVEMA, the minimum value EMRMN of the mixing ratio error is corrected by the following relation (steps 63, 66, 68):

$$EMRMN = EMRMN + |EMRAS - AVEMA| \times EMASG\# \quad (14).$$

In both of the above relations, EMASG# is the maximum and minimum correction gain (constant).

If EMRMX≧AVEMA (step 69), an updated learned value of the maximum mixing ratio error is found from the difference from the average value of same after acceleration (EMRMX−AVEMA) by reference to the TDTR table, and is entered in a work RAM TINDEX [°C.] (step 70). In the same way, if EMRMN≦AVEMA, an updated learned value of the minimum mixing ratio error is found from (AVEMA−EMRMN) by reference to the TDTL table, and this is entered in another work RAM TINDEX [°C.] (steps 72, 73).

Figure 12:
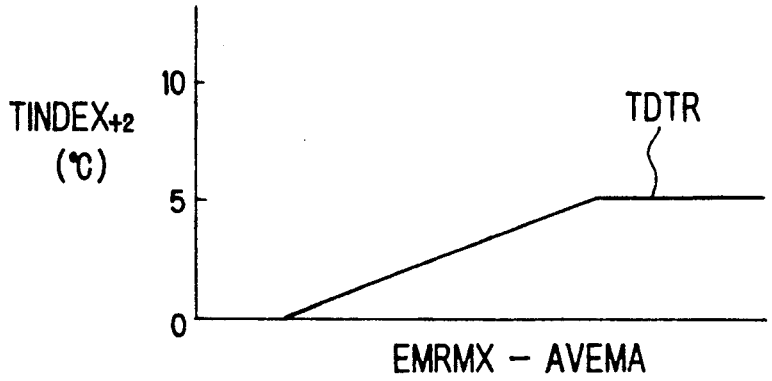
FIG. 12 is graphical representation of contents of a TDTR table used in the first embodiment of this invention.
Figure 13:
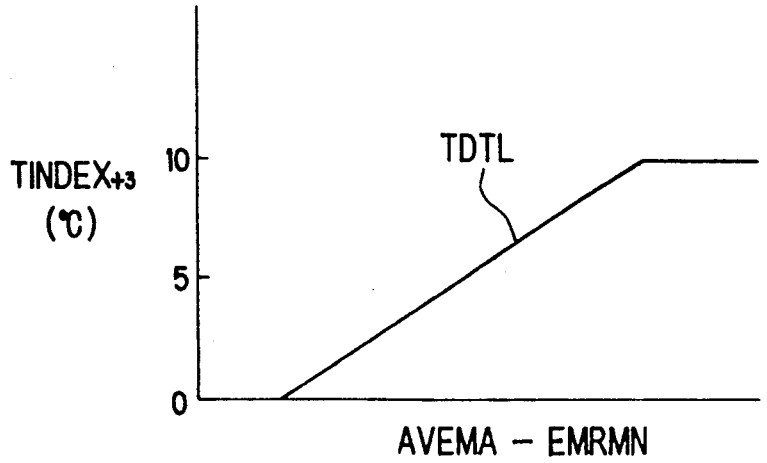
FIG. 13 is a graphical representation of contents of a TDTL table used in the first embodiment of this invention.

FIG. 12 and FIG. 13 are graphical representations of the contents of the TDTR table and TDTL table.

If EMRMX<AVEMA or EMRMN>AVEMA, EMRMX=EMRMN=AVEMA (steps 69, 71, 72, 74) as in this case there is no need for learning.

If the difference between the mixing ratio error before acceleration and the average mixing ratio error after acceleration is too great (|EMRAS−AVEMA|>KGEMAS#, where KGEMAS# is a constant), maximum and minimum value learning is not performed (steps 64, 67, 86).

Updated values of the mixing ratio error area, maximum mixing ratio error and minimum mixing ratio are found as described hereintofore, and their total is summed according to the following relation (step 75):

$$TINDEX = old\ TINDEX - TINDEX+1 + TINDEX+2 - TINDEX+3 \quad (15).$$

Using the total of these updated learned values TINDEX [°C.], the transient learned values (values in TLT table) are updated (described hereinafter), and when the updating of transient learned values is completed, a transient learning flag FTLS is cleared (steps 76, 77).

Steps 78, 79 are executed even if driving conditions do not lie within the range of learning conditions (e.g. TW<TLTWL#, TW≧TLTWTU#, N<TLNL# or N>TLNU#). Here, the transient learned temperature TLT [°C.] is searched from the water temperature TW at that time by reference to the TLT table. The wall flow correction temperature TWF used to calculate Mfh of FIG. 8 and Gztwp, Gztwm and Gztw of FIG. 7*b* is then set to a basic value TWFO [°C.], and the value obtained by adding the transient learned temperature TLT to this is set to a new wall flow correction temperature TWF [°C.]:

$$TWF = TWFO + TLT \quad (16).$$

In this way, learned values are introduced into the wall flow correction temperature. Now in the case of FIG. 15, for example, assume that the wall flow corrections (Kathos, Chosn) had to be increased overall. The steady state deposition Mfh and gains Gztwp, Gztwm and Gztw are smaller for a higher wall flow correction temperature, and the wall flow corrections have the same tendency as Mfh, Gztwp, Gztwm and Gztw. In order to increase the wall corrections, therefore, a negative value is given to the transient learned temperature TLT to decrease the apparent wall flow correction temperature.

Figure 14:
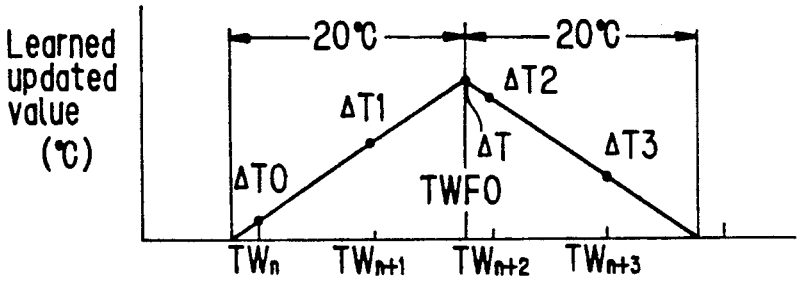
FIG. 14 is a graph describing a four-point learning system in the first embodiment of this invention.

Next, the updating of transient learned values by four-point learning in a step 76 will be described using FIG. 14.

The total learning updated value TINDEX (left-hand side in the step 75) is defined relative to the basic value TWFO. The problem is then to determine by how great a learning amount the temperature grid points TWn−TWn+3, which differ from TWFO, should be updated.

Here, it will be assumed that the updated learning amount is given by an isosceles triangle as shown in the figure (and that the learning updated amount is 0 at points 20° C. to the left and right of TWFO). Four grid points (10° C. intervals) are then taken in this 40° C. interval as shown in the figure. If the water temperature at these grid points is TWn, TWn+1, TWn+2, TWn+3 [°C.], and if the learning amounts at these grid points are ΔT0, ΔT1, ΔT2 and ΔT3 [°C.], the updated values ΔT0−ΔT3 can be calculated from the following relations:

$$\Delta T0 = \Delta T \times \{10 - (TWFO - TWn+1)\}/20 \quad (a)$$

$$\Delta T1 = \Delta T \times \{10 + (TWFO - TWn+1)\}/20 \quad (b)$$

$$\Delta T2 = \Delta T - \Delta T0 \quad (c)$$

$$\Delta T3 = \Delta T - \Delta T1 \quad (d).$$

ΔT is the height to the apex of the triangle, and it is equivalent to the total learned value updating amount TINDEX.

Figure 5:
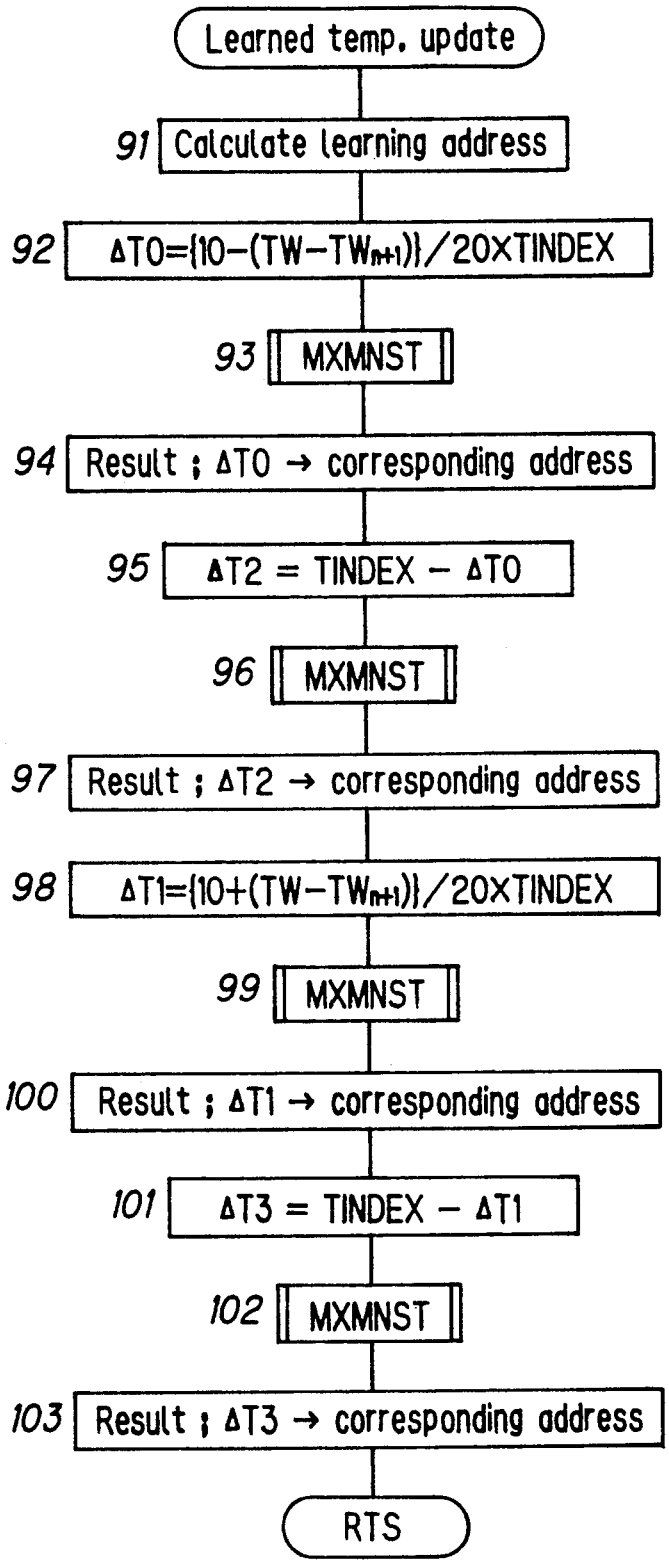
Figure 6:
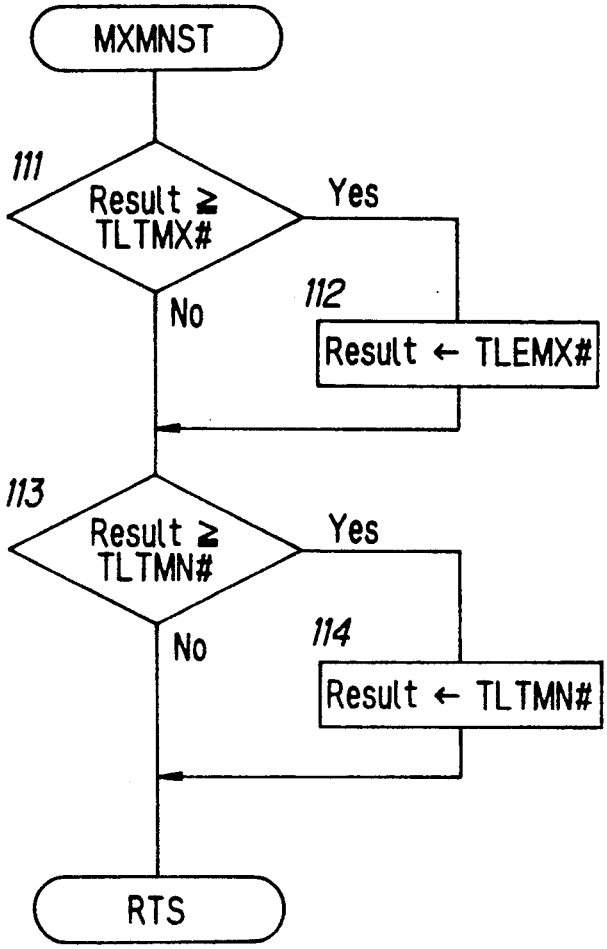

FIG. 5 is a routine to implement the updating of these learned values.

In a step 91, a learning address is calculated from the TLT table. Four temperature grid points (TWn, TWN+1, TWn+2, TWn+3, where n does not refer to specific cylinders), are defined. Learned updating amounts ΔT0−ΔT3 for each grid point are then found from equations (a)–(d), and addresses corresponding to values updated by these amounts are stored (steps 92, 94, 95, 97, 98, 100, 101, 103).

Steps 93, 96, 99 and 102 are upper and lower limits of the transient learning temperature. If, as in FIG. 6, ΔT0–ΔT3 (marked as "result" in the figure) is above a transient learning temperature upper limit (constant) TLTMX# [°C.], it is limited by this upper limit TLTMX#, while if the result is below a transient learning temperature lower limit (constant) TLTMN# [°C.], it is limited by this lower limit TLTMN#.

If there is a steady state error and this error is considered as a transient error, the transient learned temperature TLT would be mistakenly updated by this amount.

In this embodiment, therefore, mixing ratio errors during acceleration (SEMRA/NS−$AVEMA_{FIN}$ for the mixing ratio error area, EMRMN−$AVEMA_{FIN}$ for the minimum value of mixing ratio error and EMRMX−$AVEMA_{FIN}$ for the maximum value of mixing ratio error) are determined based on the average mixing ratio error when acceleration is completed.

In other words, $AVEMA_{FIN}$ corresponds to the steady state error, and subtracting it is equivalent to separating the transient error and the steady state error. Even if a steady state error occurs due to scatter or time variation of the injector or air flow meter, therefore, it does not affect the precision of transient learning.

Further, the mixing ratio error EMRA is moreover calculated using the real mixing ratio MRO (FIG. 16, step 7) which varies due to exhaust pulsation and the like even under steady state conditions. If EMRA is used to denote a value when acceleration is completed, therefore, the transient learned values will also fluctuate and precision will fall.

In this example, EMRA is averaged (smoothed) by the coefficient KAVEMA# (step 8). As shown in the lower part of FIG. 15, this averaged value varies smoothly without being affected by fluctuations of the real mixing ratio error MRO. The value after acceleration is completed is therefore stable, and fluctuation of learned results can be minimized.

Figure 18:
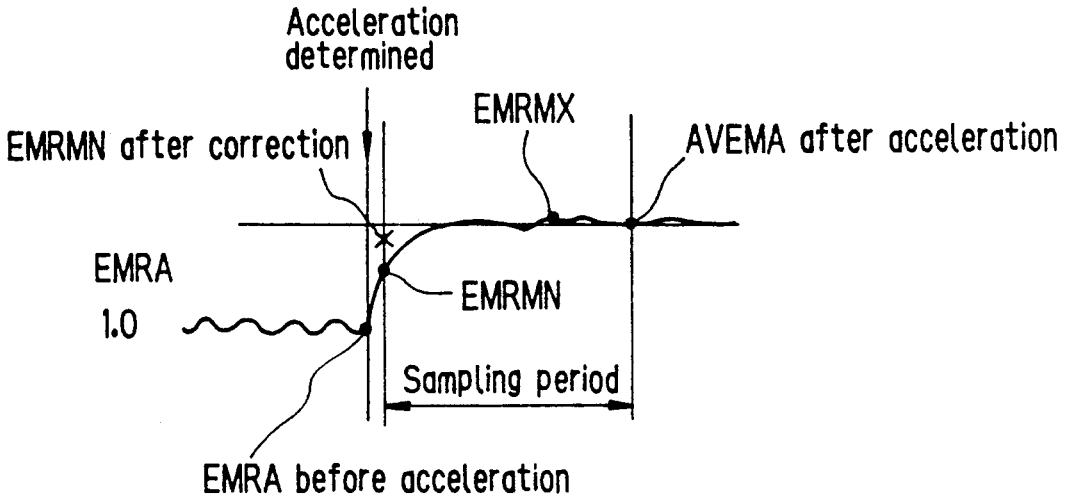

Further, in this example, the mixing ratio error EMRAS and the average mixing ratio error after acceleration is completed $AVEMA_{FIN}$ are sampled, and the mixing ratio error area MRA, minimum value of mixing ratio error EMRMN and maximum value of mixing ratio error EMRMX are corrected based on the difference between them (steps 54, 57, 65, 68). In the example of FIG. 18, there was a large difference between EMRAS and $AVEMA_{FIN}$. Due to the transition pattern between them, EMRMN is regarded bigger than its real state. EMRMN is therefore increased up to the point shown in FIG. 18 by applying a correction.

By excluding errors arising from different acceleration conditions using this correction, the precision of transient learning can be increased.

Figure 22:
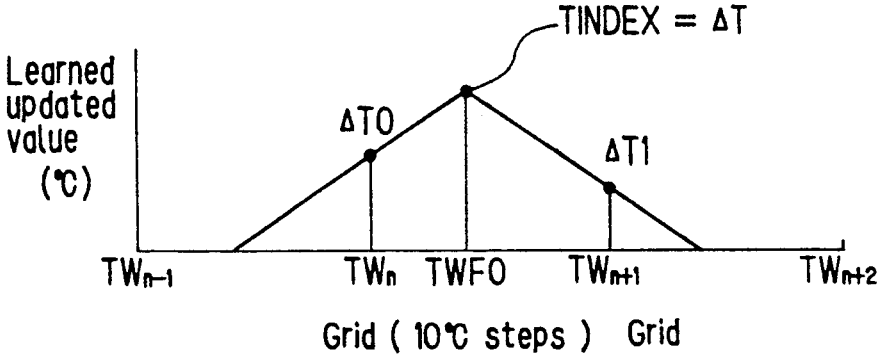
FIG. 22 is a graph describing a two-point learning system in the first embodiment of this invention.

The updating of transient learned values in the step 76 can be performed by two point learning. In this case amounts ΔTO and ΔT1 at the two grid positions TWn, TWn as shown in FIG. 22 are calculated as follows:

$$\Delta T0 = \Delta T - \Delta T1 \quad \text{(e)}$$

$$\Delta T1 = \Delta T \times (TWFO - TWn)/10 \quad \text{(f)}.$$

Next, in this example, updating of transient learned values is performed on the basis of the mixing ratio error, and the maximum and minimum values of the mixing ratio error, in the sampling period. This will now be described in further detail.

Figure 20B:
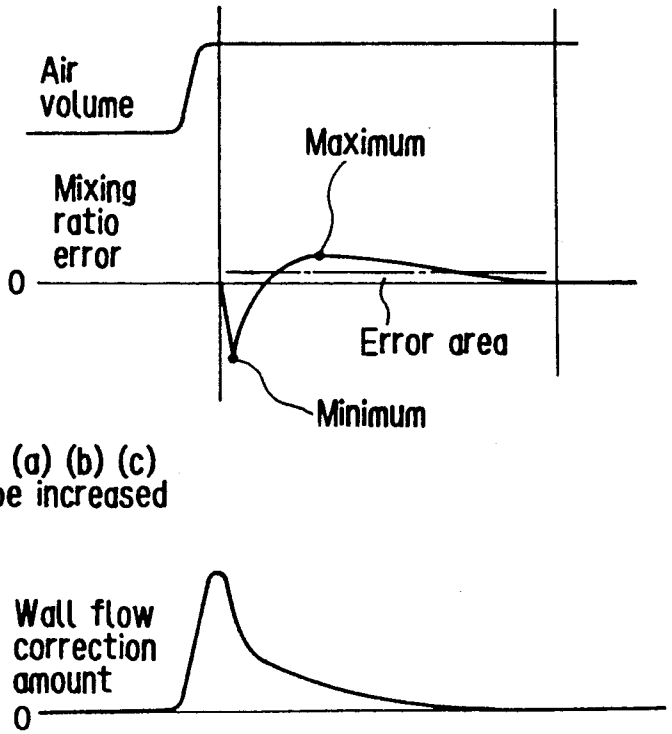
FIGS. 20*a* and 20*b* are graphs showing a mixing ratio error where the maximum and minimum values of mixing ratio error are respectively not included and included in a learning process of the first embodiment of this invention.
Figure 20A:
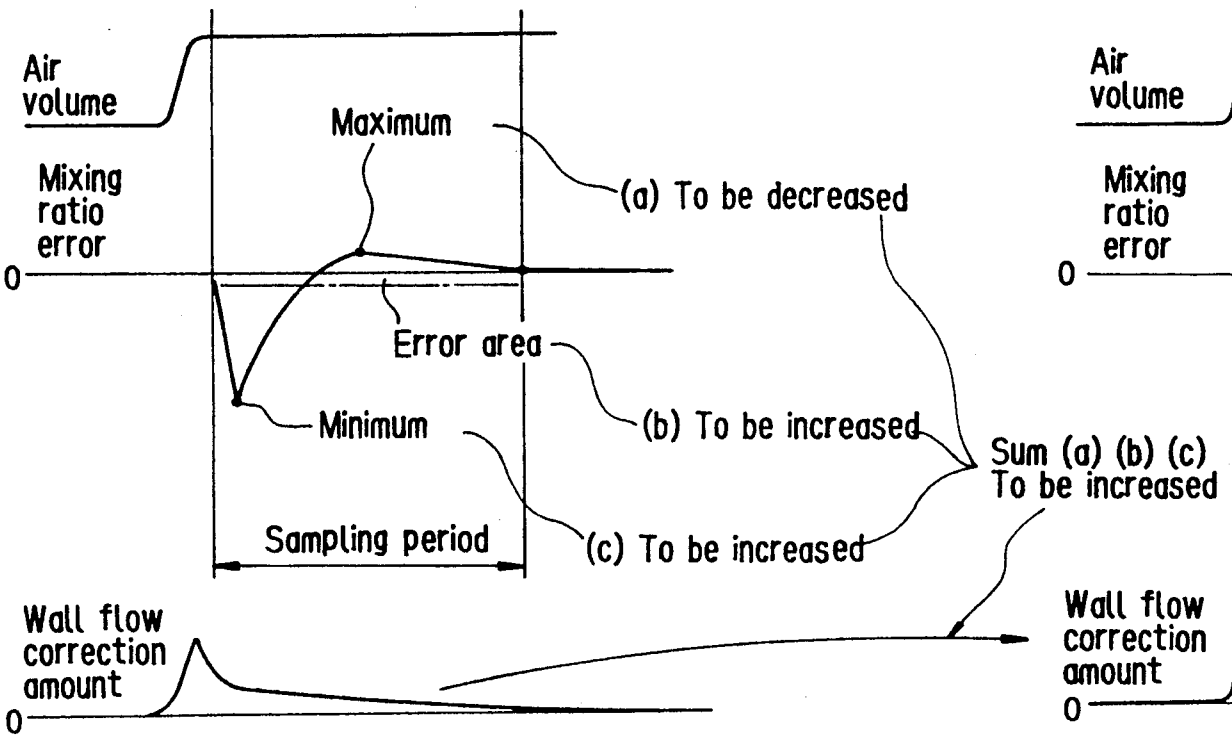
Figure 21:
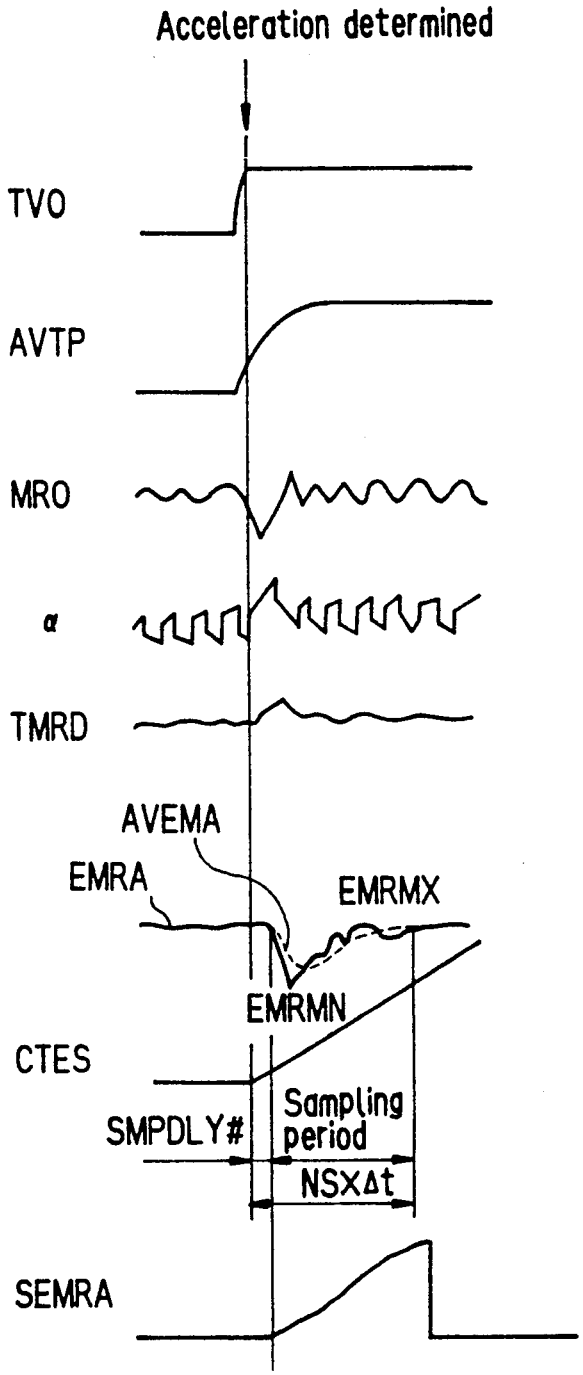
FIG. 21 is a graph showing the variation of parameters when a vehicle is accelerating in the first embodiment of this invention.

In FIG. 20*a* which shows the situation before transient learning, the value of the mixing ratio error area SEMRA in the sampling period (acceleration period) is negative. This indicates that the real mixing ratio is on the lean side, and consequently the wall flow correction must be increased to make the mixing ratio richer.

Similarly, the minimum value of mixing ratio error EMRMN is much smaller than the reference value of the mixing ratio error (AVEMA) after acceleration, so the wall flow correction must be considerably increased to make the mixing ratio richer.

However, the maximum value of the mixing ratio error EMRMX is only slightly greater than the reference value (AVEMA), so the wall flow correction must be returned slightly to make the mixing ratio to the lean side.

In this case, learning updated amounts are calculated independently from the mixing ratio error area SEMRA, minimum value of mixing ratio error EMRMN and maximum value of mixing ratio error EMRMX ($TINDEX_{+1}$ for the mixing ratio error area, $TINDEX_{+3}$ for the minimum value of mixing ratio error, and $TINDEX_{+2}$ for the maximum value of mixing ratio error, all these values being positive quantities). From the characteristics of FIGS. 11–13, the relative magnitudes of these quantities are expressed by the relation:

$$TINDEX_{+1} + TINDEX_{+3} > TINDEX_{+2}.$$

According to equation (15), therefore, the total learning updated amount TINDEX is a negative value, and the transient learning temperature TLT in the TLT table is replaced by a smaller value.

As a result, when the transient learned temperature TLT read after learning becomes smaller, the wall flow correction temperature TWF is less than the value before learning. After learning, therefore, as shown in FIG. 20*b*, the wall flow correction is increased by an amount corresponding to this TLT, the lean peak of the mixing ratio error during acceleration is suppressed, and the mixing ratio error area is also small.

In other words, in this example, by finding the mixing ratio error area during acceleration and incorporating it in the learned values, the scatter in the learned values can be reduced. Likewise, by incorporating the maximum and minimum values of the mixing error ratio during acceleration in the learned values, the occurrence of a large lean peak or a large rich peak can be avoided, driving performance is not impaired due to hesitation or stumbling, and exhaust emissions can be kept at a low level by area learning.

Figure 23:
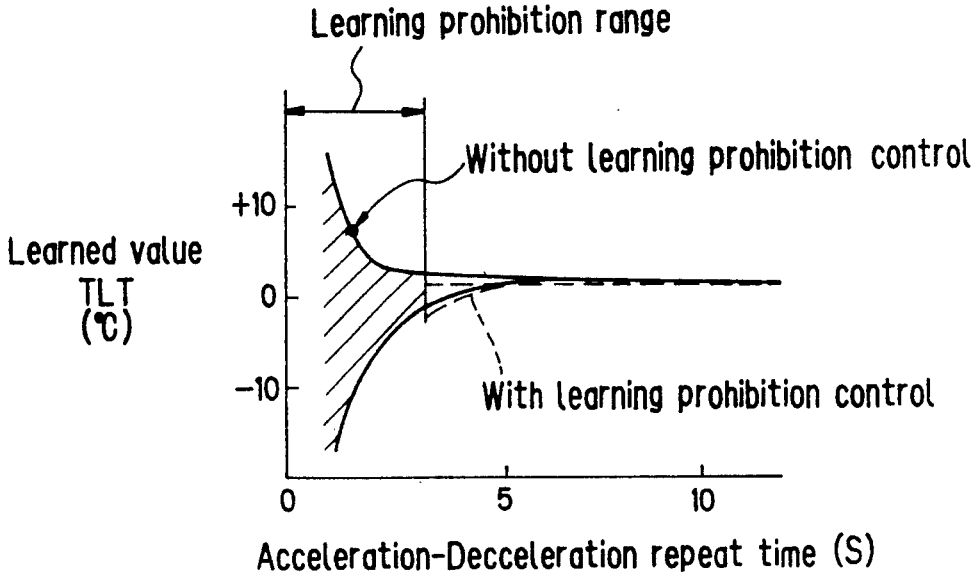
FIG. 23 is a graph showing acceleration/deceleration repeat time and scatter of learned values in the first embodiment of this invention.

However, if transient learning is performed in every transient condition, the learned values will be widely scattered and unstable as shown in FIG. 23 when acceleration and deceleration are repeated in short intervals so that the mixing ratio error is increased during and after transient control.

To cope with this problem, in this embodiment, transient learning is prohibited if either of the following learning prohibition conditions is satisfied (steps 51, 85, steps 53, 56, 85, or steps 64, 67, 86).

(a-1) the difference of average value of mixing ratio error before and after acceleration does not lie within a predetermined range ($|AVEST - AVEMA_{FIN}| > KGKSAE\#$, where the average value of mixing ratio error after acceleration is completed is represented by $AVEMA_{FIN}$).

(a-2) the difference between the mixing ratio error when the vehicle is judged to be accelerating and the average value of mixing ratio error after acceleration is completed, does not lie within a predetermined range ($|EMRAS - AVEMA_{FIN}| > KGEMRS\#$ for learning error area, and $|EMRAS - AVEMA_{FIN}| > KGEMAS\#$ for maximum and minimum learning errors).

From FIG. 23, it is evident that by establishing a range where learning is prohibited within a range where learned values are widely scattered, learning values which were so far stable are not destabilized, and a high learning precision is maintained.

The boundaries of the range where learning is prohibited are defined by the aforesaid predetermined values (KGKSAE#, KGEMRS#, KGEMAS#)

Learning prohibition under the following conditions also gives similar effect as in the aforesaid cases (a-1), (a-2):

(b) the period where it is judged that the engine is accelerating, or the mixing ratio error immediately preceding it, lie outside predetermined ranges (e.g. |AVEST|>predetermined value, |EMRAS|>predetermined value).

(c) the mixing ratio error after acceleration is completed lies outside a predetermined range (e.g. $|AVEMA_{FIN}|$>predetermined value).

Further, in this embodiment, three preceding data for TMR and $\alpha$ are used for the MR at the current time as in the aforesaid equation (7).

As the routine of FIG. 2 for sampling TMR, $\alpha$ and MR is performed every 240° turn of the crankshaft, and 240°×3= 720°, this is equivalent to two engine revolutions. In other words, there is a delay of two revolutions between TMR, $\alpha$ and MR, and with this delay the real mixing ratio obtained from the calculation with TMR and $\alpha$ coincides with the real mixing ratio detected by the sensor.

This takes account of:

(I) Fuel response delay in the air intake pipe (due to wall flow, (II) Delay of sensor output due to response of AFR sensor.

Figure 24:
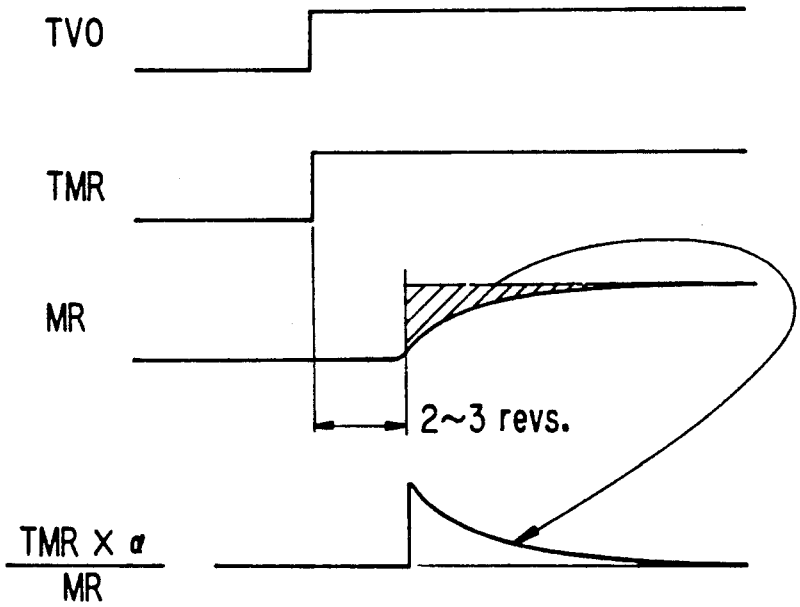
FIGS. 24 and 25 are graphs showing the variation of parameters when a vehicle is accelerating in a first embodiment of the invention.
Figure 25:
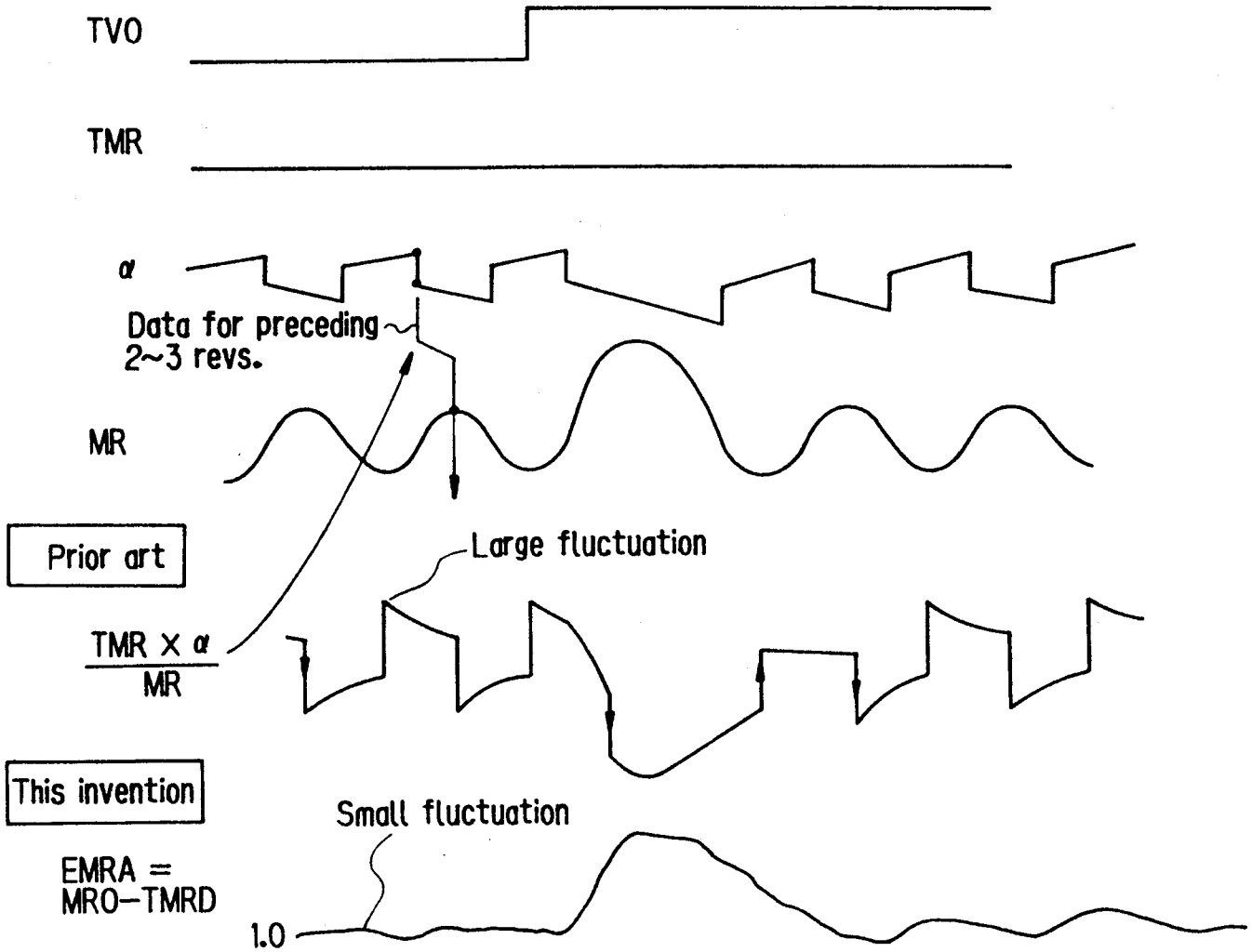

If all values for TMR, $\alpha$ and MR are taken at the same point in time, there is a risk that the shaded part of FIG. 24 would be considered as the mixing ratio error, but this disadvantage can be avoided by using old data for TMR and $\alpha$ as described hereintofore.

Further, in the embodiment, $\alpha$ (or more precisely, $\alpha$×TMR), is damped. The mixing ratio error EMRA (=MRO−TMRD) obtained from this damped value TMRD varies smoothly as shown in the lower part of FIG. 25, and the effect of the fluctuation in $\alpha$ can be removed.

Thus, by considering the delay of MR and the fluctuation in the control of $\alpha$, high error detecting precision can be maintained even in the transient period when TMR or $\alpha$ are subject to large variations and liable to fluctuate. The learning process can therefore be speeded up, and both precision and speed can be achieved in transient learning.

Figure 26:
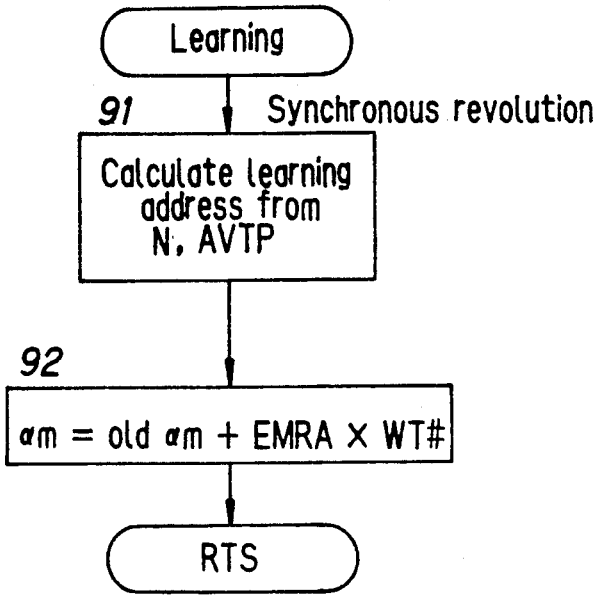
FIG. 26 is a flowchart describing control actions performed in the first embodiment of this invention when the vehicle is running at a constant speed.

Further, even during steady state conditions, a desirable effect can be obtained by updating learned values $\alpha m$ in the steady state by the following equation as shown in FIG. 26, using the aforesaid mixing ratio error EMRA.

$$\alpha m = \text{old } \alpha m + \text{EMRA} \times \text{WT\#}.$$

Figure 27:
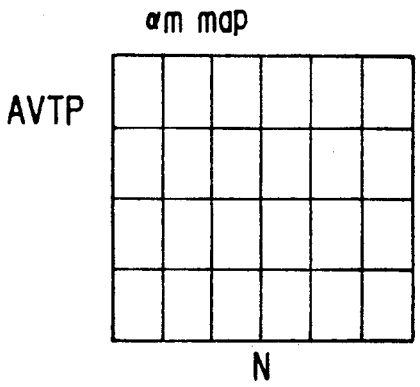
FIG. 27 shows an αm map in the first embodiment of this invention.

WT# is a learned updating proportion (constant). FIG. 27 is a map of $\alpha m$ assigned for an engine speed N and pulse width AVTP corresponding to cylinder air volume.

It is therefore possible to prevent fluctuation of learned values for a steady state due to the fluctuation in $\alpha$ arising from pulse control of fuel injection quantity.

Figure 28:
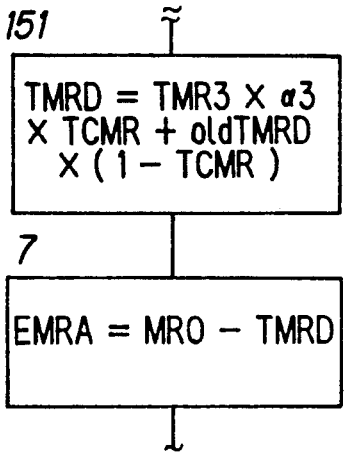
FIGS. 28 and 29 are flowcharts describing additional control actions performed in the first embodiment of this invention.
Figure 29:
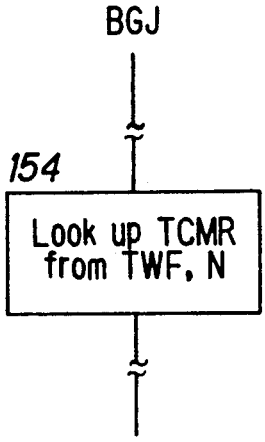
Figure 30:
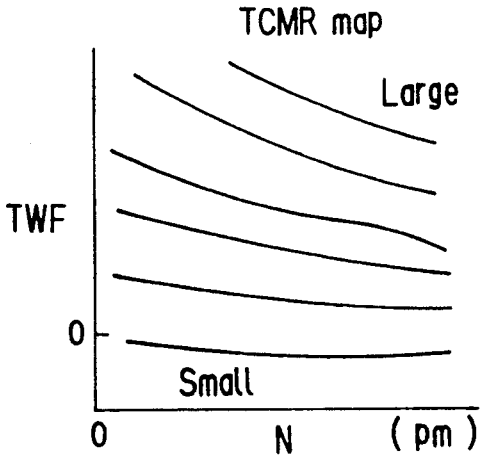
FIG. 30 shows a TCMR map used in the first embodiment of this invention.

Further, as shown in FIGS. 28 and 29, the damping coefficient TCMR may be a variable. As the response delay of fuel wall flow in the air intake passage varies with the wall flow temperature and the engine speed, precision can be increased by assigning the damping coefficient TCMR to correspond with these parameters. A TCMR map may for example be set up as a function of the wall flow correction temperature TWF and the engine speed N as in FIG. 30, reference being made to this map in a step 154 and TMRD calculated by the equation of a step 151 instead of the step 6 in FIG. 2.

Figure 31:
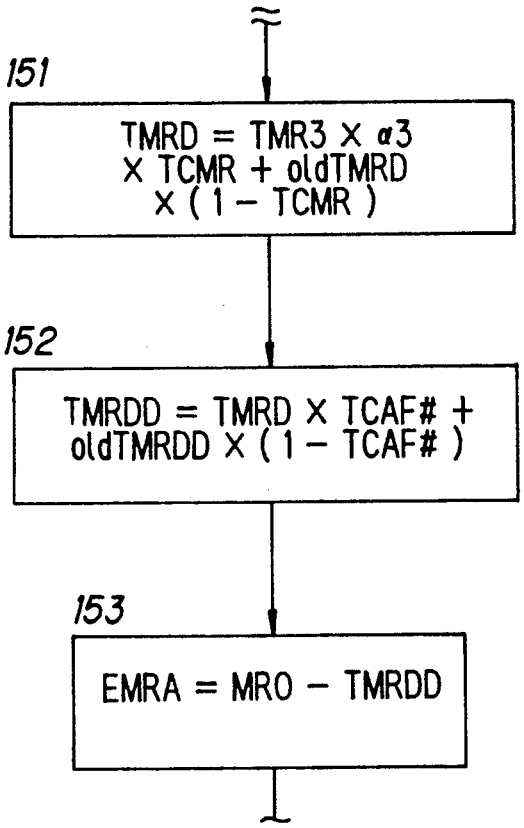
FIG. 31 is a flowchart describing additional control actions performed in the first embodiment of this invention.

FIG. 31 shows a case wherein the damped value of the target air fuel ratio TMRD is further damped by a damping coefficient (constant) related to the response of the AFR sensor:

$$\text{TMRDD} = \text{TMRD} \times \text{TCAF\#} + \text{old TMRDD} \times (1 - \text{TCAF\#}).$$

This corresponds to separating the fuel wall flow delay and the sensor output delay corresponding to the aforesaid (I) and (II), and it is valid if the AFR sensor 12 is situated at a relatively downstream location of the exhaust pipe.

The mixing ratio error EMRA is expressed either in the form of a difference (step 7 in FIG. 2 and FIG. 28, step 153 in FIG. 31), or the learned value $\alpha m$ is expressed in the form of a sum (step 126 in FIG. 7*a*). EMRA may however be expressed also in the form of a ratio, and $\alpha m$ in the form of a product.

Next, a second embodiment of this invention will be described with reference to FIGS. 32–45. In this description, parts of the structure which are the same as those of the first embodiment will be omitted.

In the arrangement of FIG. 1, an $O_2$ sensor is used instead of the AFR sensor 12 which detects the AFR continuously from rich to lean as in the aforesaid embodiment. This sensor reacts to the $O_2$ concentration in the exhaust gas, and it has a sharp output variation at the theoretical AFR.

The control operations represented by the aforesaid equations (1)–(5) are also applied to this embodiment.

Figure 32:
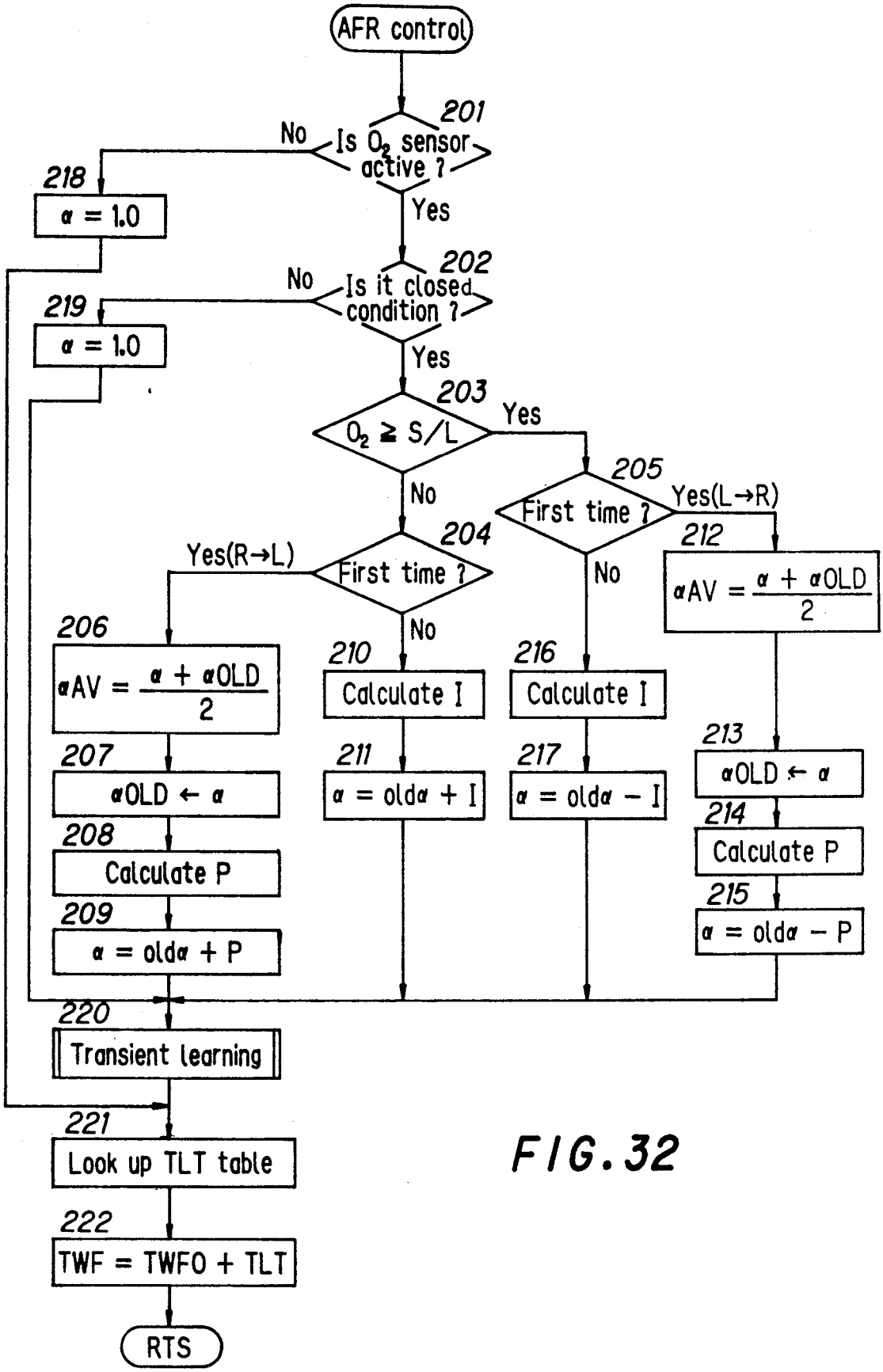
FIGS. 32-34 are flowcharts describing control actions performed in a second embodiment of this invention.
Figure 33:
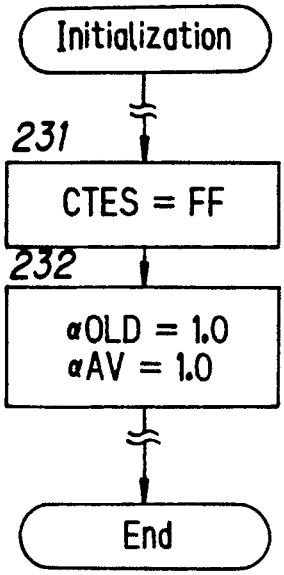

FIG. 32 is a routine for calculating an AFR feedback correction coefficient $\alpha$ based on the output of the $O_2$ sensor. This control is synchronized with the engine revolution.

Provided that the $O_2$ sensor is active (step 201), it is examined whether or not the AFR feedback control conditions detected by the $O_2$ sensor (designated as closed conditions in the drawings) are satisfied (step 202), and if these conditions are satisfied, the program proceeds to a step 203. It is judged that these conditions are not satisfied if the cooling water temperature TW is below a predetermined value, if the output of the $O_2$ sensor has not reversed even once, if the amount of fuel is increased during start-up, immediately after start-up or during warming-up, and if the fuel supply is cut, otherwise it is judged that these conditions are satisfied.

If AFR feedback control is represented as a process of linear integration, each period in the process may be viewed as consisting of four steps (1)–(4), as follows:

(1) When the AFR is changed from rich to lean, it is first corrected stepwise by proportional parts P towards the rich side, (2) During the following lean period, it is then gradually corrected in integral parts I toward the rich side.

(3) To change the AFR from lean to rich, it is first corrected stepwise by proportional parts P towards the lean side, (4) During the following rich period, it is then gradually corrected in integral parts I toward the lean side.

These four cases are distinguished by comparing the magnitude of the $O_2$ sensor output in steps 203–205 (referred simply as "$O_2$" in the figures) to that of a predetermined slice level S/L (target value corresponding to the $O_2$ sensor output for the theoretical AFR), and to that of the output on the immediately preceding occasion. Herein, the real AFR is rich if $O_2 \geqq S/L$, and lean if $O_2 < S/L$.

A progression through the steps 203, 204, 206 corresponds to a change from rich to lean. Likewise, a progression through the steps 203, 204, 210 corresponds to a continuation of lean, progression through the steps 203, 205, 212 corresponds to a change from lean to rich, and a progression through the steps 203, 205, 216 corresponds to a continuation of rich.

After distinguishing the aforesaid four cases, the proportional parts P and the integral parts I are calculated depending on the case by means of the following relations:

$$P = KP \times \text{ERROR} \quad (17)$$

$$I = \text{Old}I + KI \times \text{ERROR} \quad (18)$$

wherein ERROR is an AFR error previously expressed as a deviation from the theoretical AFR, and KP is a proportional gain. Further, KI is an integral gain. These gains may also take different values on the rich side and the lean side.

In steps 209, 211, 215, and 217, the feedback correction coefficient $\alpha$ is calculated using these proportional parts and integral parts. The meaning of the expressions in the figures is that the value which was stored in the RAM $\alpha$ is extracted, increased or decreased by a correction amount (P,I) per control operation, and the increased or decreased value is replaced in $\alpha$.

Further, when the AFR ratio changes from rich to lean and vice-versa, the average value of the $\alpha$ in the immediately preceding calculation and the value stored in the RAM $\alpha$ OLD is calculated from the relation:

$$\alpha AV = (\alpha + \alpha\text{OLD})/2 \quad (19)$$

(steps 206, 212), and the $\alpha$ in the immediately preceding calculation is replaced in the RAM $\alpha$ OLD (steps 207, 213).

Figure 38:
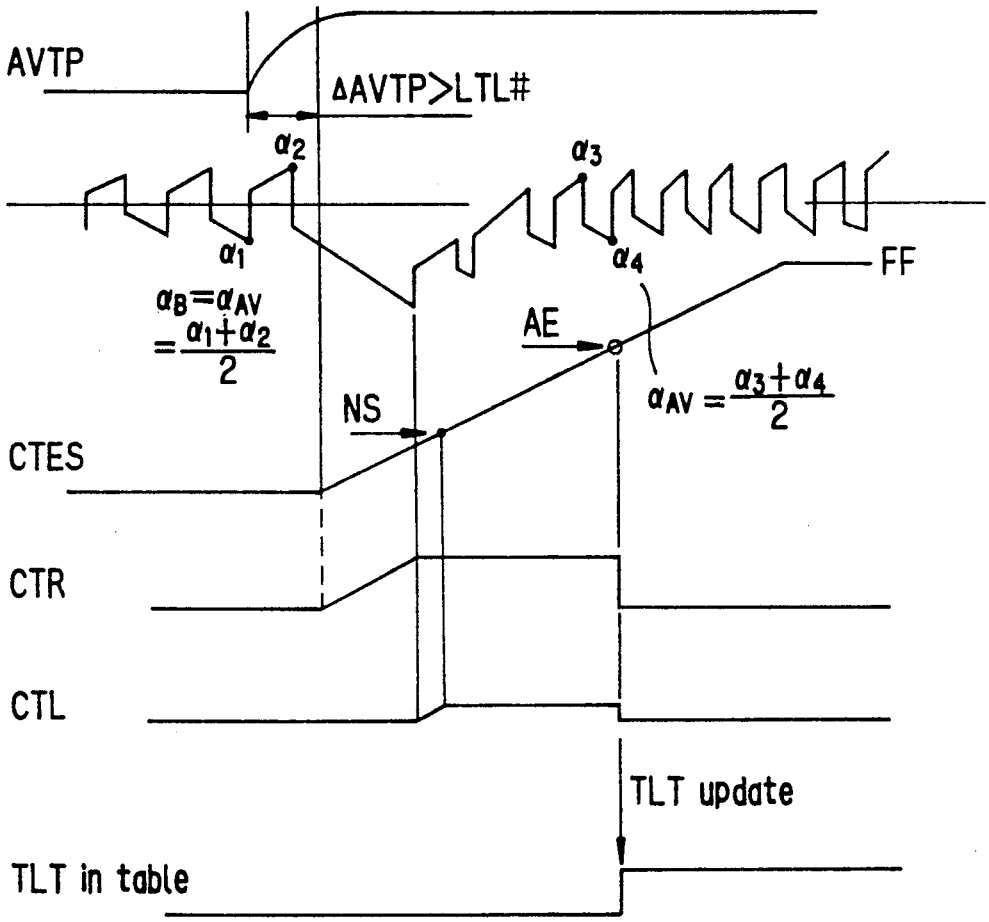
FIG. 38 is a graph showing the variation of different parameters during acceleration in the second embodiment of this invention.

As a result, the value input in the step 213 is used in the step 206 (the value input in the step 207 is used in the step 212), and $\alpha$ AV is therefore equal to the average value of $\alpha$ in a half cycle. In FIG. 38, for example, $\alpha AV = (\alpha 3 + \alpha 4)/2$ is calculated in the step 206, and $\alpha AV = (\alpha 1 + \alpha 2)/2$ is calculated in the step 212.

When the calculation of $\alpha$ is complete, transient learning is performed in a step 220. This transient learning requires that at least the AFR feedback control conditions are satisfied, and an acceleration is experienced as described hereinafter.

Figure 34:
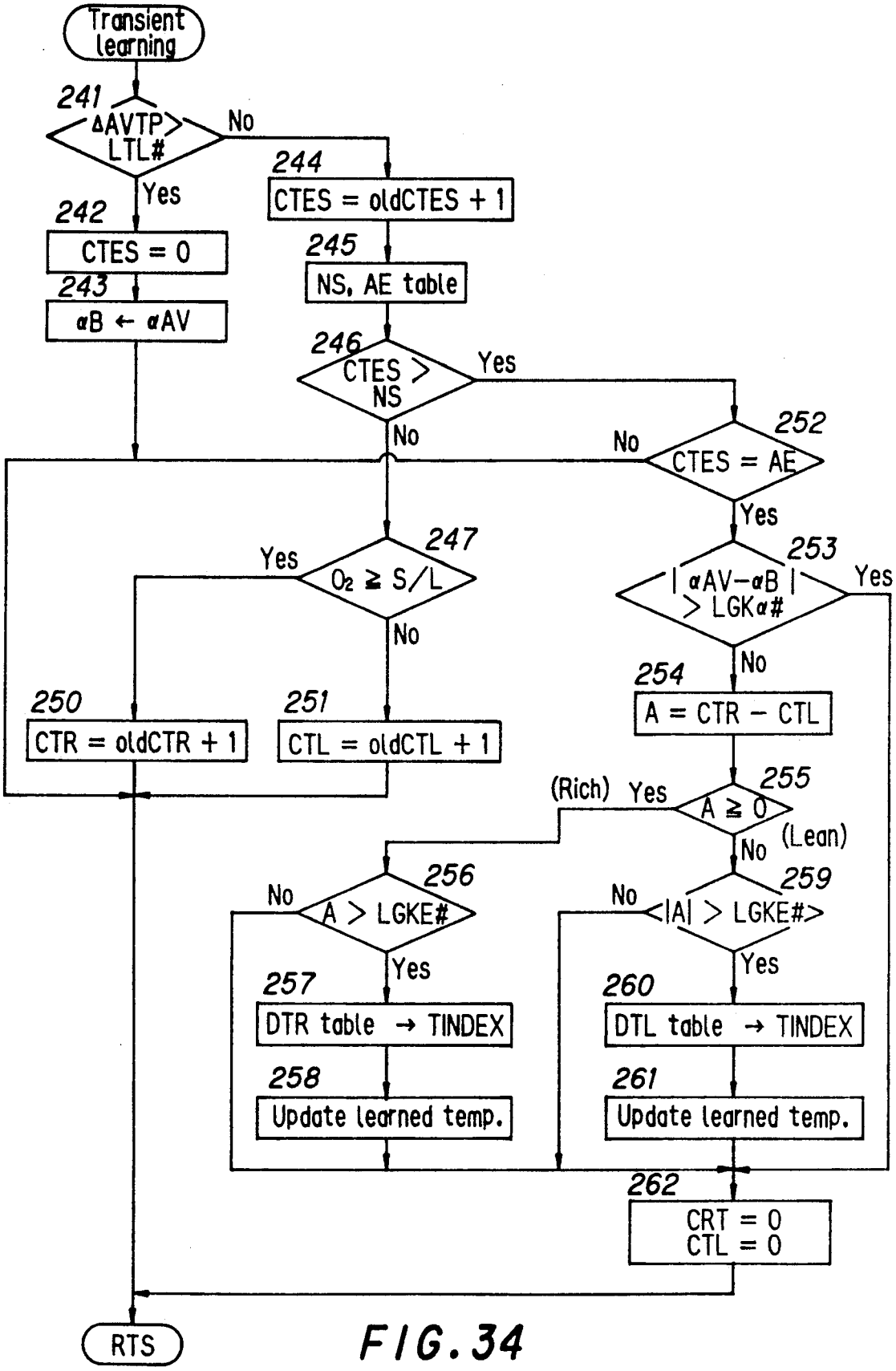

FIG. 34 is a routine for performing transient learning at a fixed period, no distinction being made between cylinders.

In a step 241, a comparison is made between $\Delta$AVTP (AVTP − old AVTP) and a transient learning judgement level (constant) LTL#. If $\Delta AVTP \geqq LTL\#$, the value in $\alpha$AV is transferred to another RAM $\alpha$B. The value of $\alpha$AV when acceleration is judged to begin (i.e. immediately before acceleration) enters $\alpha$B.

Further if $\Delta AVTP \geqq LTL\#$, the data sampling count value CTES is reset (step 242).

If on the other hand $\Delta AVTP < LTL\#$, the count value CTES is increased by:

$$\text{CTES} = \text{Old CTES} + 1$$

(step 244), and the NS table and AE tables are looked up from the water temperature TW at that time (step 245).

Figure 35:
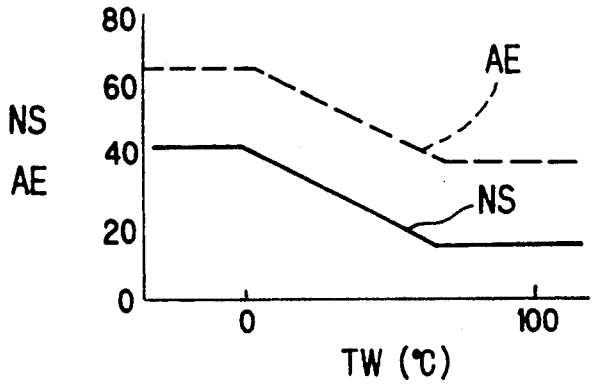
FIG. 35 is a graphical representation of the contents of NS and AE tables used in the second embodiment of this invention.

Here, NS is a number defined according to the sampling period. In a step 245, the count value CTES is compared to the sampling period number NS. Until $\text{CTES} \leqq \text{NS}$, the count value CTR is increased if the AFR is on the rich side, and another count value CTL is increased if the AFR is on the lean side, according to the result of comparing the $O_2$ sensor output and the slice level S/L (steps 247, 250, 251). CTR therefore represents the time during which the AFR is on the rich side, and CTL represents the time during which the AFR is on the lean side. FIG. 35 shows the contents of the NS table and AE table.

AE(AE > NS) is a number which the engine is judged to be in a steady state after acceleration is complete. If the engine is judged to be in a steady state from CTES = AE in a step 252, the program proceeds to update learned values in a step 254 (step 253 will be described later).

If there is an acceleration or deceleration immediately after an NS interval, therefore, the program does not proceed to step 254 and further steps.

Learned values are updated by calculating the difference A (= CTR − CTL) between the two counter values for measuring rich time and lean time (step 254). This time difference A corresponds to the AFR error. It is also possible to use a ratio instead of a difference.

The sign of this time difference A is examined in a step 255. If $A \geqq 0$, a learned updating value is calculated from A by looking up a DTR table, and is entered in the work RAM TINDEX [°C.] (step 257). Similarly, if $A < 0$, a learned updating value found from A by looking up a DTL table, is entered in TINDEX [°C.] (step 260).

Figure 36:
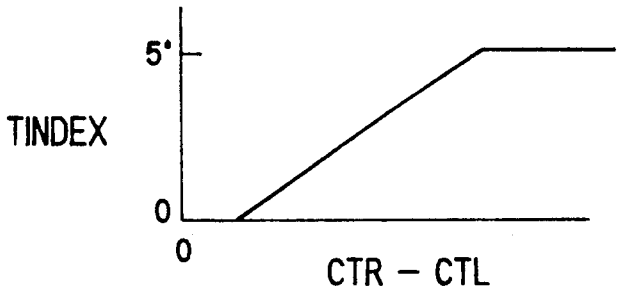
FIG. 36 is a graphical representation of the contents of a DTR table used in the second embodiment of this invention.
Figure 37:
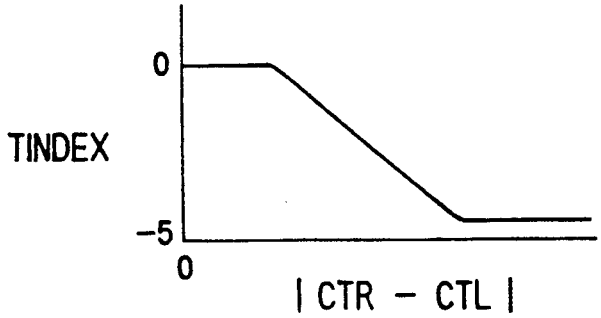
FIG. 37 is a graphical representation of the contents of a DTL table used in the second embodiment of this invention.

FIG. 36 shows the contents of the DTR table. In the figure, the updating value is set equal to O when A (= CTR − CTL) is small, and is set equal to a constant when A is large, in order to stabilize learned values. The DTL table shown in FIG. 37 is similar.

Transient learned values (the values in the TLT table) are thus updated by the learned updating value TINDEX (described hereinafter), and when the updating of transient learned values is complete, the values in CTR and CTL are cleared (steps 258, 261, 262).

On the other hand, in a step 253, the difference between the value in $\alpha$AV when the engine is judged to be in a steady state (i.e. the value after acceleration is complete) and the value extracted from $\alpha$B (i.e. the value immediately before acceleration) is compared with a predetermined value (constant) LGK$\alpha$#. If $|\alpha AV - \alpha B| > LGK\alpha\#$, the program proceeds to a step 262 without updating learned values. This is due to the fact that even if the transient learning conditions are satisfied, an error appears in the learned values and the transient AFR is subject to scatter if the learned values are updated when there is too great a difference in the average value of $\alpha$ before and after acceleration.

Further, if the time difference A is within an insensitive band ($A \leqq LGKE\#$ or $|A| \leqq LGKE\#$, where LGKE# is a constant value defining the width of the insensitive band), the program skips steps 257 and 258 or steps 260 and 261, and learned values are not updated.

Returning to FIG. 32, in steps 221, 222, the transient learned temperature TLT [°C.] is searched from the water temperature TW at that time by looking up the TLT table. The wall flow correction temperature TWF used in calculating Mfh in FIG. 8 and Gztwp, Gztwm, Gztw in FIG. 7 is then reset equal to the basic value of the wall flow correction temperature TWFO [°C.], and the value obtained by adding the transient learned temperature TLT to this is taken as the new wall flow correction temperature TWF [°C.].

The learning temperature updating in the steps 258 and 261 is the same as that in the example of the aforesaid first embodiment.

However, even if the transient learning conditions are satisfied, an error appears in the transient learning temperature TLT when the difference in the average value of $\alpha$ before and after acceleration is large compared to the case when this is not so. This is due to the fact that there is a scatter in $\alpha$, this scatter being due to the following causes:

(a) An error appears in the AFR due to scatter in the characteristics of the air flow meter and injector, causing scatter in $\alpha$. The scatter in $\alpha$ is different according to the running conditions of the engine. Moreover, as the $O_2$ sensor can detect only two values, i.e. whether the air-fuel mixture is on the rich or the lean side of the theoretical AFR, and can not measure the amount of scatter.

Figure 41:
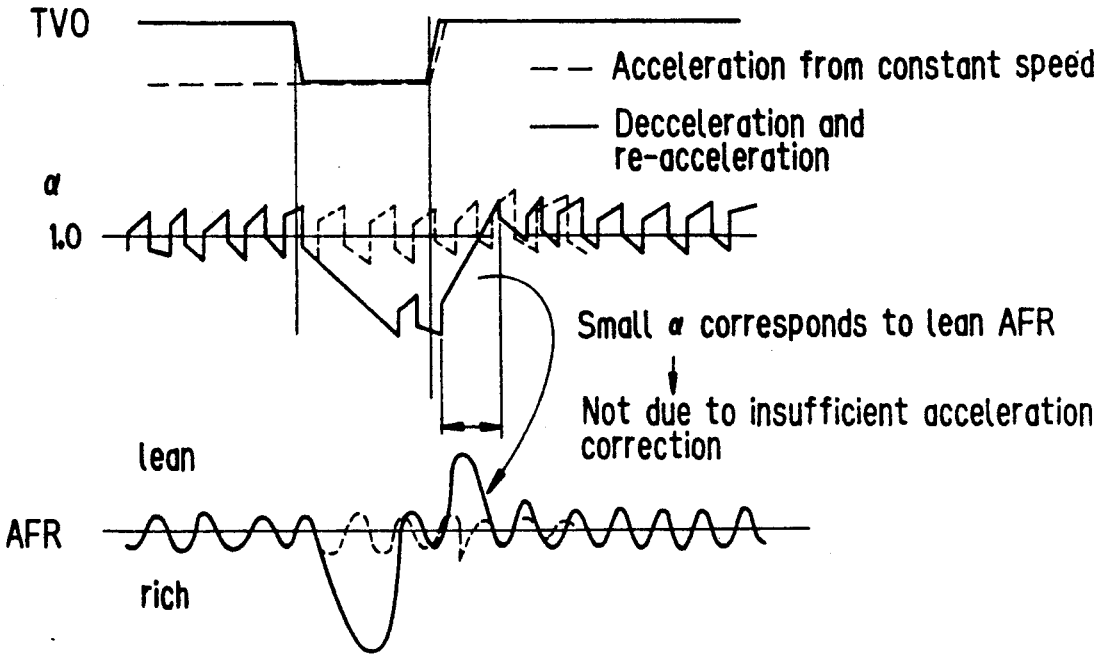
FIG. 41 is a graph showing TVO, α and AFR during reacceleration immediately after deceleration for the purpose of describing prohibition of lean time count in the second embodiment of this invention.
Figure 42:
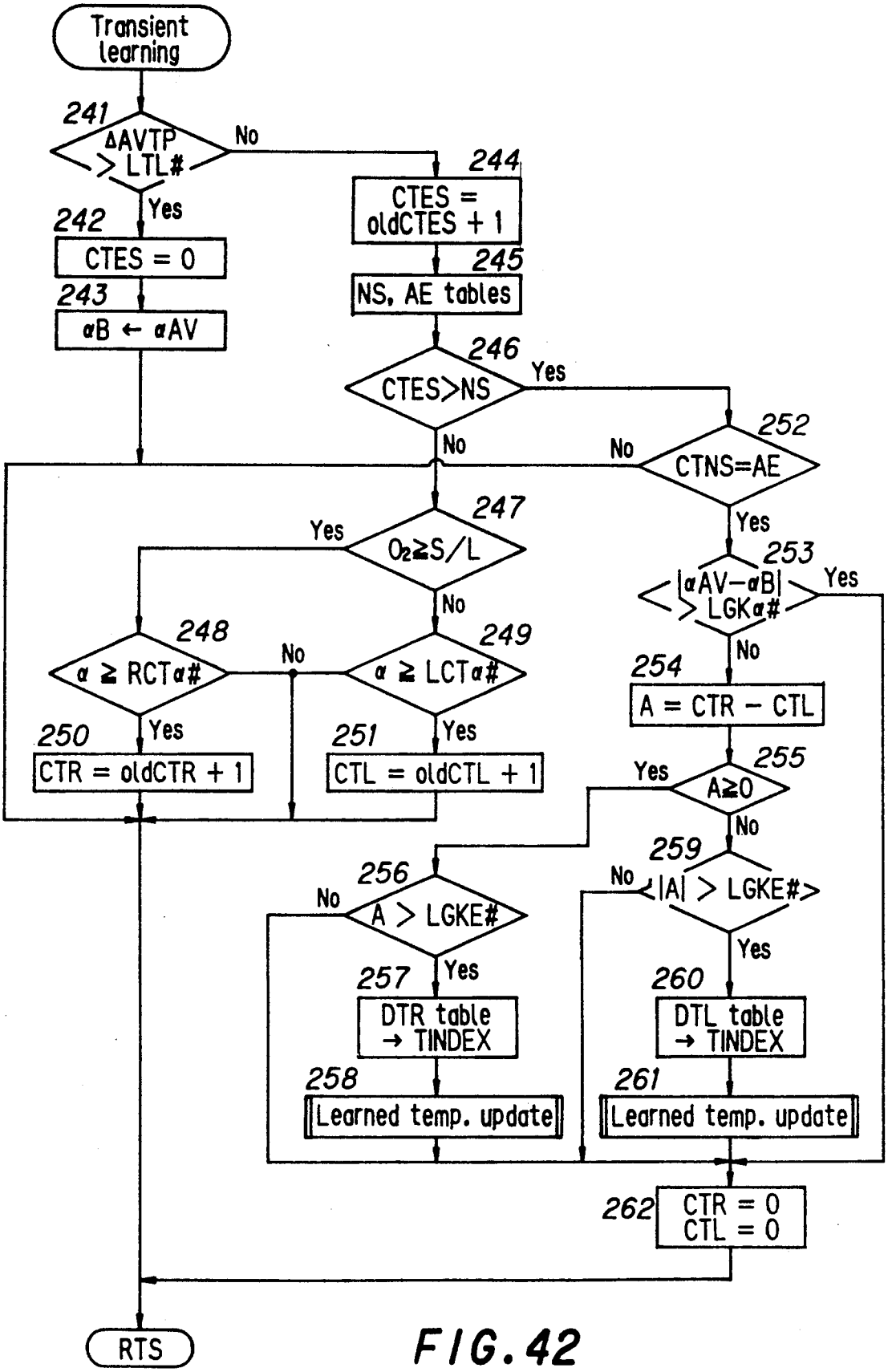
FIG. 42 is similar to FIG. 34, but describing alternative control actions that can be performed in the second embodiment of this invention.

(b) Generally, during deceleration, if there is a slight air measuring delay or scatter in the fuel wall flow to the cylinder depending on volatility of gasoline or valve deposits, the AFR is shifted to the rich side and $\alpha$ is largely shifted to the lean side as a result as shown in FIG. 41.

As shown by the acceleration immediately following deceleration shown in this figure, therefore, if transient learning is performed beyond the point where the difference in the average value of $\alpha$ before and after acceleration reaches a certain level, errors appear in the learned values and the transient AFR is scattered. In this regard, the AFR is not necessarily shifted to the lean side during deceleration, and may also be shifted to the rich side.

In this embodiment, however, in the step 253 which precedes the updating of learned values (FIG. 34), if the difference between the $\alpha AV$ ($=\alpha B$) when the vehicle is judged to be accelerating and the $\alpha AV$ after acceleration is completed, lies outside a predetermined range, the program does not proceed to the steps 254–261, and transient learning is prohibited. In other words, by prohibiting transient learning, the destabilization of stable previously learned values is prevented, and a high learning precision is maintained.

Errors are thus prevented from affecting the transient learning temperature TLT in a transition period due to air measuring delay, scatter of injector characteristics or scatter of wall flow into the cylinder, and high precision of learned values is ensured.

Figure 39:
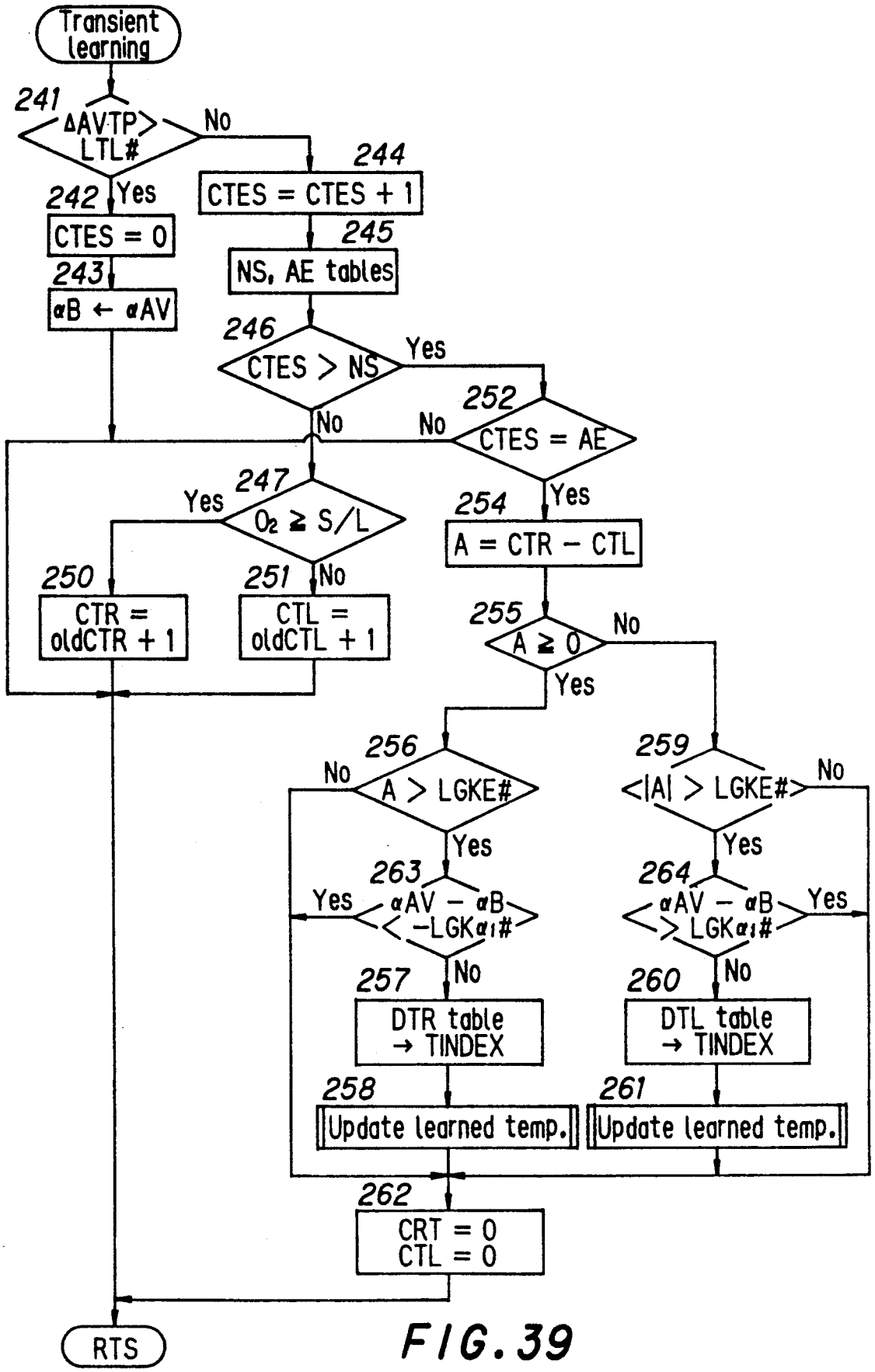
FIG. 39 is similar to FIG. 34, but describing alternative control actions that can be performed in the second embodiment of this invention.
Figure 40:
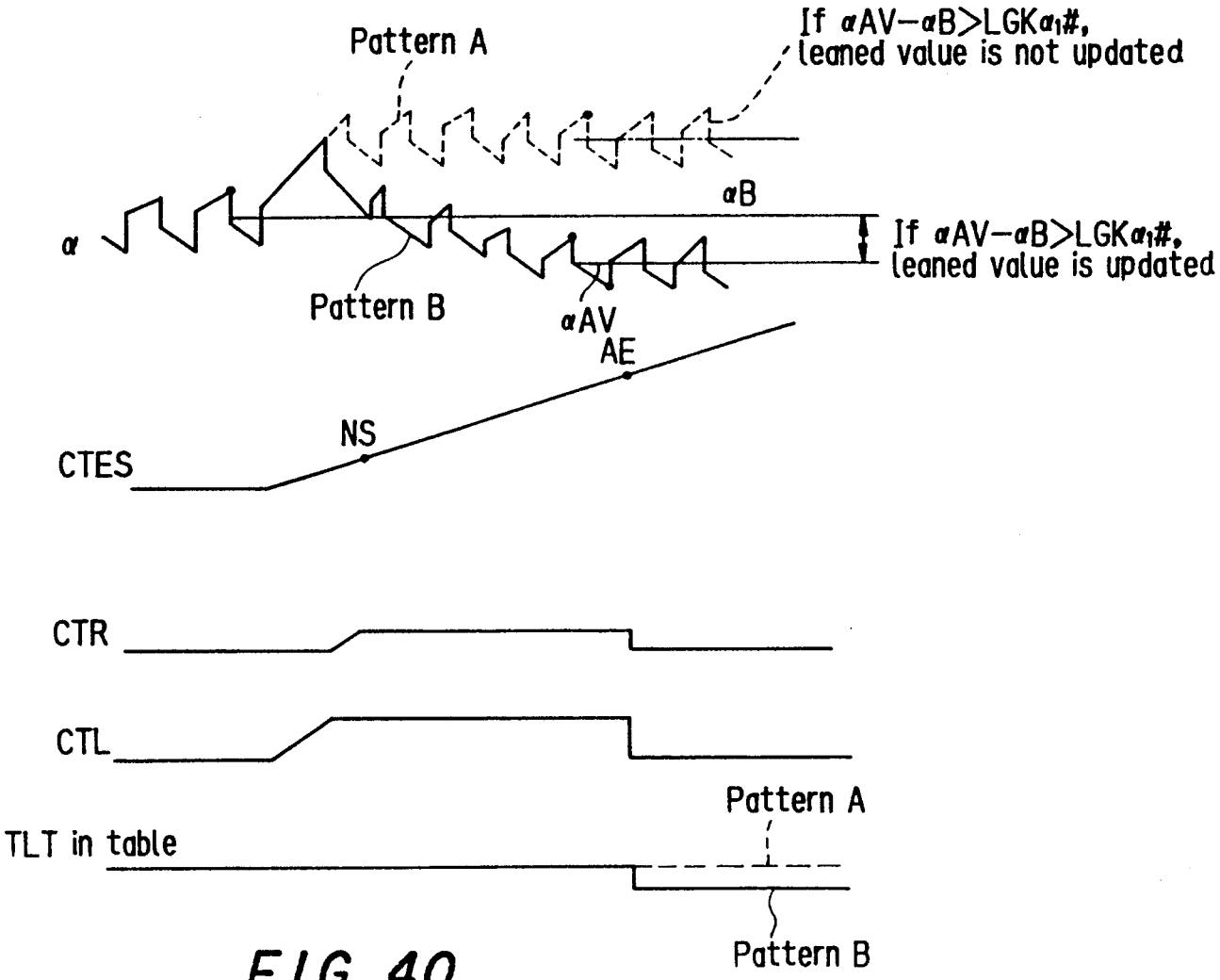
FIG. 40 is a graph showing the variation of α and CTL during acceleration in the second embodiment of this invention.

Further, FIG. 39 may be applied instead of FIG. 34.

This is a means of skipping steps which update learned values in the direction of increasing wall flow correction, if the real AFR is lean ($A<0$), and the value of $\alpha$ after acceleration is complete is much greater than its value immediately before acceleration (i.e. if $\alpha AV-\alpha B<LGK\alpha 1\#$, where $LGK\alpha 1\#$ is a constant) (steps 255, 264, 262).

The wall flow correction amount has to be increased if the AFR is lean. If $\alpha$ after acceleration is small, learning is not sufficient and so learned values must be updated (see pattern B of FIG. 40). However, if the AFR is lean and $\alpha$ after acceleration is large, a learning error does not necessarily exist (see pattern A of FIG. 40). The learned values are therefore updated only when there is definitely an error in these values (steps 255, 264, 260, 261).

Similarly, learned values are not updated in the direction of decreasing wall flow correction if the real AFR is rich and the value of $\alpha$ after acceleration is complete is much less than its value immediately before acceleration (i.e. if $\alpha AV-\alpha B<-LGK\alpha 1\#$) (steps 255, 263, 262).

In this embodiment, there are more learning opportunities than in the previous embodiment. The frequency of learning can therefore be increased, and a suitable AFR can be set rapidly when fuel is being supplied, etc.

Figure 43:
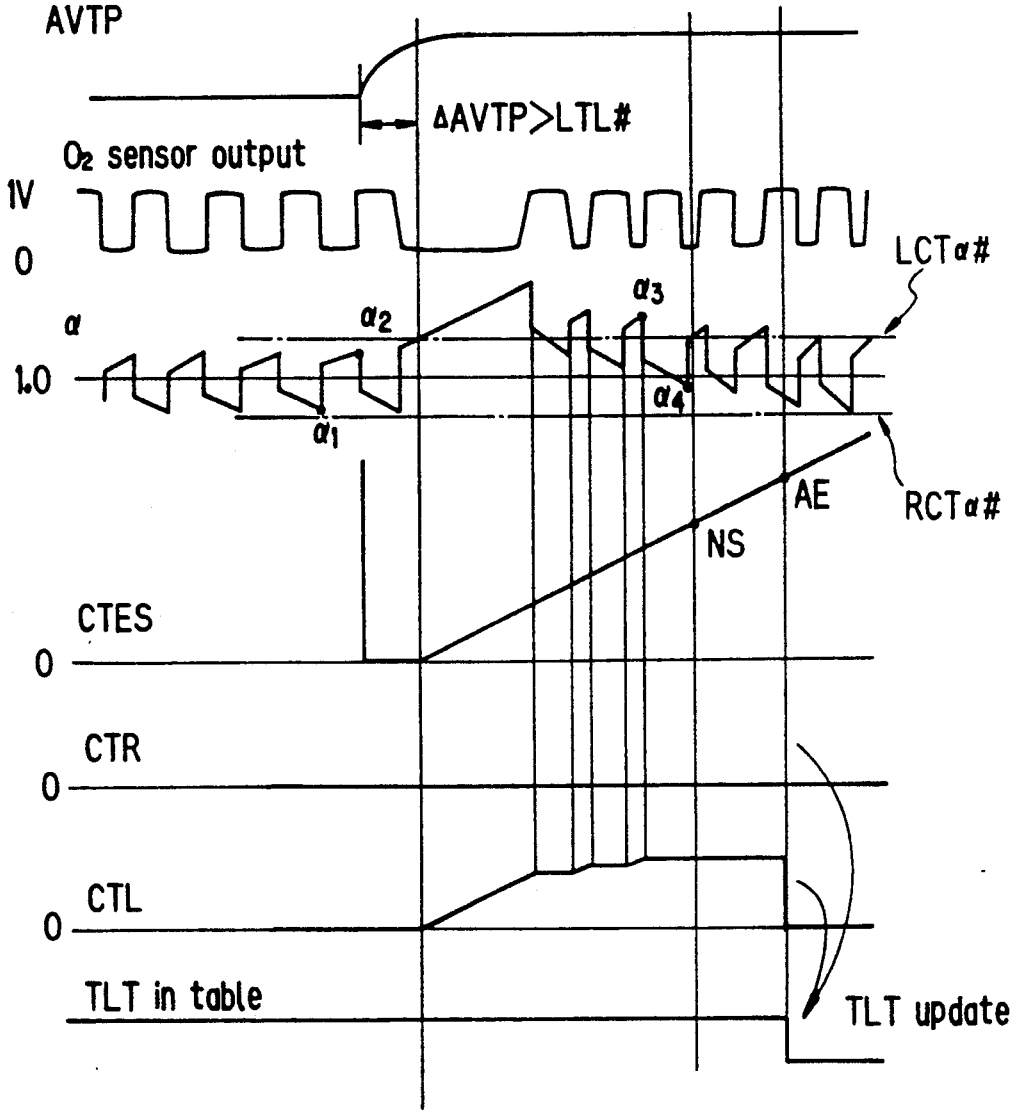
FIG. 43 is a graph showing the variation of different parameters during acceleration in the second embodiment of this invention.

The flowcharts of FIG. 41 and FIG. 43 may also be used instead of FIG. 34.

In FIG. 41, steps 248 and 249 have been added to the flowchart of FIG. 34. Even if the real AFR is lean, therefore, the lean time is not counted if $\alpha$ is less than a predetermined value (i.e. $O_2<S/L$ and $\alpha<LCT\alpha\#$). This also covers the type of case shown in FIG. 41.

In the case shown in FIG. 41, for example, it is better to definitively exclude this lean time rather than to include it when it contains errors. The destabilization of stable previously learned values is thereby prevented, and a high learning precision is maintained.

Similarly, if the real AFR is rich and $\alpha$ is greater than a predetermined value $RCT\alpha\#$, not counting the rich time prevents destabilization of learned values.

Errors are thus prevented from affecting the transient learning temperature TLT in a transition period due to air measuring delay, scatter of injector characteristics or scatter of wall flow into the cylinder, and high precision of learned values is ensured.

Figure 44:
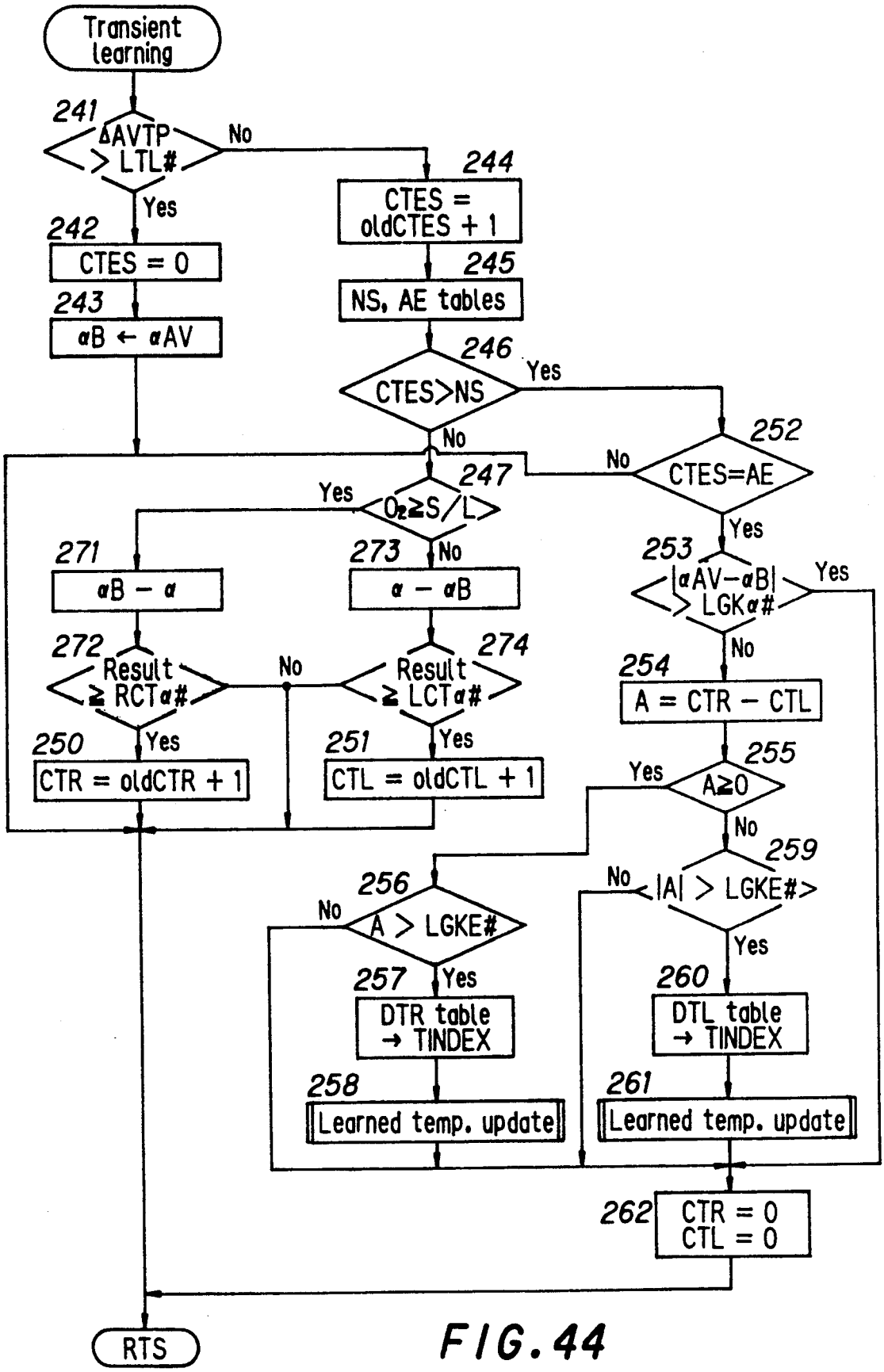
FIG. 44 is similar to FIG. 34, but describing alternative control actions that can be performed in the second embodiment of this invention.

In the flowchart of FIG. 44, steps 271–274 are executed instead of the steps 248 and 249.

Figure 45:
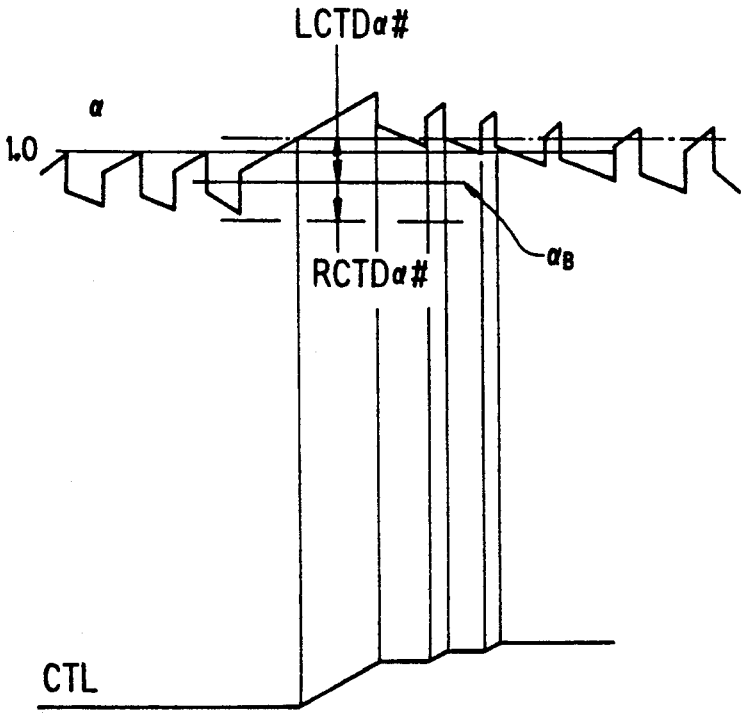
FIG. 45 is a graph showing the variation of various parameters during acceleration in the second embodiment of this invention.

This is because although it is necessary to count lean time to supplement learning insufficiencies if the real AFR is lean and the difference in $\alpha$ during acceleration and before acceleration ($\alpha-\alpha B$) is greater than a predetermined value $LCTD\alpha\#$ (e.g. 0.05) (i.e. $O_2\geqq S/L$ and $\alpha-\alpha B\geqq LCTD\alpha\#$) (steps 247, 273, 274, 251), a learning error does not necessarily exist if the AFR is lean and $\alpha-\alpha B<LCTD\alpha\#$, so this flowchart does not count lean time as shown in FIG. 45.

This is particularly effective when transient learning does not proceed and the $\alpha$ before acceleration is shifted from its control center value of 1.0, as for example when there is no map learning control of steady state AFR or when, even if there is such control, the learning conditions are not satisfied (e.g. for low water temperature, etc.). The lean time and the rich time may also be counted in synchronism with the engine revolution.

The foregoing description of a preferred embodiment for the purpose of illustrating this invention is not to be considered as limiting or restricting the invention, since many modifications may be made by those skilled in the art without departing from the scope of the invention such as, for example, its application to a Single Point Injection System.

The embodiments of this invention in which an exclusive property or privilege is claimed are defined as follows:

1. An air-fuel ratio controller for a water-cooled engine having a cylinder, an intake passage surrounded by a wall which provides air to said cylinder, and a fuel injector injecting fuel in said intake passage, comprising:

sensors for detecting engine load and speed, means for computing a basic fuel injection amount of said fuel injector based on the detected value of the engine load and speed, a sensor for detecting engine coolant water temperature, a sensor for detecting a real mixing ratio of the fuel and air provided in said cylinder by said fuel injector and intake passage, means for detecting a mixing ratio error from a difference between the value detected by said mixing ratio sensor and a predetermined target mixing ratio, means for judging whether or not the engine is in a transient state, means for computing a basic correction amount regarding a wall flow according to said detected water temperature, said wall flow being a flow of fuel along said wall of said intake passage, means for performing learning related to said basic correction amount of the wall flow based on the mixing ratio error detected by said mixing ratio error detection means when the engine is in the transient state, a memory for storing values learned by said learning performing means, as transient learned values, means for searching said memory for a transient learned value when the engine re-enters the transient state, means for computing a wall flow correction amount based on said searched transient learned value and said basic correction amount of the wall flow, means for correcting said basic fuel injection amount by said computed wall flow correction amount, means for outputting said corrected injection amount to said fuel injector, means for judging whether or not the transient state has terminated, means for setting the difference between the outputs of said mixing ratio error detecting means in the transient state and after termination of the transient state, as a transient mixing ratio error, and means for updating a transient learned value stored in said memory such that said transient mixing error decreases.

2. An air-fuel ratio controller for a water-cooled engine having a cylinder, an intake passage surrounded by a wall which provides air to said cylinder, and a fuel injector injecting fuel in said intake passage, comprising:

sensors for detecting engine load and speed, means for computing a basic fuel injection amount of said fuel injector based on the detected value of the engine load and speed, a sensor for detecting engine coolant water temperature, a sensor for detecting a real mixing ratio of the fuel and air provided in said cylinder by said fuel injector and intake passage, means for detecting a mixing ratio error from a difference between the value detected by said real mixing ratio sensor and a predetermined target mixing ratio, means for averaging the output of said mixing ratio error detecting means, means for judging whether or not the engine is in a transient state, means for computing a basic correction amount regarding a wall flow according to said detected water temperature, said wall flow being a flow of fuel along said wall of said intake passage, means for performing learning related to said basic correction amount of the wall flow based on the mixing ratio error detected by said mixing ratio error detection means when the engine is in the transient state, a memory for storing values learned by said learning performing means, as transient learned values, means for searching said memory for a transient learned value when the engine re-enters the transient state, means for computing a wall flow correction amount based on said searched transient learned value and said basic correction amount of the wall flow, means for correcting said basic fuel injection amount by said computed wall flow correction amount, means for outputting said corrected injection amount to said fuel injector, means for judging whether or not the transient state has terminated, means for setting the difference between the output of said mixing ratio error detecting means in the transient state and the output of said averaging means after the termination of the transient state, as a transient mixing ratio error, and means for updating a transient learned value stored in said memory such that said transient mixing ratio error decreases.

3. An air-fuel ratio controller for a water-cooled engine having a cylinder, an intake passage surrounded by a wall which provides air to said cylinder, and a fuel injector injecting fuel in said intake passage, comprising:

a sensor for detecting engine load and speed, means for computing a basic fuel injection amount of said fuel injector based on the detected value of the engine load and speed, a sensor for detecting engine coolant water temperature, a sensor for detecting a real mixing ratio of the fuel and air provided in said cylinder by said fuel injector and intake passage, means for detecting a mixing ratio error from a difference between the value detected by said real mixing ratio sensor and a predetermined target mixing ratio, means for judging whether or not the engine is in a transient state, means for computing a basic correction amount regarding a wall flow according to said detected water temperature, said wall flow being a flow of fuel along said wall of said intake passage, means for performing learning related to said basic correction amount of the wall flow based on the mixing ratio error detected by said mixing ratio error detection means when the engine is in the transient state, a memory for storing values learned by said learning performing means, as transient learned values, means for searching said memory for a transient learned value when the engine re-enters the transient state, means for computing a wall flow correction amount based on said searched transient learned value and said basic correction amount of the wall flow, means for correcting said basic fuel injection amount by said computed wall flow correction amount, means for outputting said corrected injection amount to said fuel injector, means for judging whether or not the transient state has terminated, means for judging whether the engine is in a pre-transient state, means for setting the difference between the outputs of said mixing ratio error detecting means in the pre-transient state and after the termination of the transient state, as a transient mixing ratio error, and means for updating a transient learned value stored in said memory such that said transient mixing ratio error decreases.

4. An air-fuel ratio controller for a water-cooled engine having a cylinder, an intake passage surrounded by a wall which provides air to said cylinder, and a fuel injector injecting fuel in said intake passage, comprising:

sensor for detecting engine load and speed, means for computing a basic fuel injection amount of said fuel injector based on the detected value of the engine load and speed, a sensor for detecting engine coolant water temperature, a sensor for detecting a real mixing ratio of the fuel and air provided in said cylinder by said fuel injector and intake passage, means for detecting a mixing ratio error from a difference between the value detected by said real mixing ratio sensor and a predetermined target mixing ratio, means for judging whether or not the engine is in a transient state, means for computing a basic correction amount regarding a wall flow according to said detected water temperature, said wall flow being a flow of fuel along said wall of said intake passage, means for performing learning related to said basic correction amount of the wall flow based on the mixing ratio error detected by said mixing ratio error detection means when the engine is in the transient state, a memory for storing values learned by said learning performing means, as transient learned values, means for searching said memory for a transient learned value when the engine re-enters the transient state, means for computing a wall flow correction amount based on said searched transient learned value and said basic correction amount of the wall flow, means for correcting said basic fuel injection amount by said computed wall flow correction amount, means for outputting said corrected injection amount to said fuel injector, means for computing an integral value of the mixing ratio error in a predetermined sampling interval based on the output of said mixing ratio error detecting means under the transient conditions, and for computing the maximum and minimum values of the mixing ratio error in this interval, and means for updating a transient learned value stored in said memory based on said integral, maximum and minimum values such that said mixing ratio error in the transient state decreases.

5. An air-fuel ratio controller for a water-cooled engine having a cylinder, an intake passage surrounded by a wall which provides air to said cylinder, and a fuel injector injecting in said intake passage, comprising:

sensors for detecting engine load and speed, means for computing a basic fuel injection amount of said fuel injector based on the detected value of the engine load and speed, a sensor for detecting engine coolant water temperature, a sensor for detecting a real mixing ratio of the fuel and air provided in said cylinder by said fuel injector and intake passage, means for detecting a mixing ratio error from a difference between the value detected by said real mixing ratio sensor and a predetermined target mixing ratio, means for judging whether or not the engine is in a transient state, means for computing a basic correction amount regarding a wall flow according to said detected water temperature, said wall flow being a flow of fuel along said wall of said intake passage, means for performing learning related to said basic correction amount of the wall flow based on the mixing ratio error detected by said mixing ratio error detection means when the engine is in the transient state, a memory for storing values learned by said learning performing means, as transient learned values, means for searching said memory for a transient learned value when the engine re-enters the transient state, means for computing a wall flow correction amount based on said searched transient learned value and said basic correction amount of the wall flow, means for correcting said basic fuel injection amount by said computed wall flow correction amount, means for outputting said corrected injection amount to said fuel injector, means for updating said transient learned value stored in said memory such that said mixing ratio error under the transient state decreases, means for judging whether the engine is in a pre-transient state, means for judging whether or not said mixing ratio error detected in the pre-transient state lies within a predetermined range, and means for prohibiting updating of said transient learned value when said pre-transient error does not lie within the predetermined range.

6. An air-fuel ratio controller for a water-cooled engine having a cylinder, an intake passage surrounded by a wall which provides air to said cylinder, and a fuel injector injecting fuel in said intake passage, comprising:

sensors for detecting engine load and speed, means for computing a basic fuel injection amount of said fuel injector based on the detected value of the engine load and speed, a sensor for detecting engine coolant water temperature, a sensor for detecting a real mixing ratio of the fuel and air provided in said cylinder by said fuel injector and intake passage, means for detecting a mixing ratio error from a difference between the value detected by said real mixing ratio sensor and a predetermined target mixing ratio, means for judging whether or not the engine is in a transient state, means for computing a basic correction amount regarding a wall flow according to said detected water temperature, said wall flow being a flow of fuel along said wall of said intake passage, means for performing learning related to said basic correction amount of the wall flow based on the mixing ratio error detected by said mixing ratio error detection means when the engine is in the transient state, a memory for storing values learned by said learning performing means, as transient learned values, means for searching said memory for a transient learned value when the engine re-enters the transient state, means for computing a wall flow correction amount based on said searched transient learned value and said basic correction amount of the wall flow, means for correcting said basic fuel injection amount by said computed wall flow correction amount, means for outputting said corrected injection amount to said fuel injector, means for updating said transient learned value stored in said memory such that said mixing ratio error under the transient state decreases, means for judging whether the engine is in a post-transient state, means for judging whether or not said mixing ratio error detected in the post-transient state lies within a predetermined range, and means for prohibiting updating of said transient learned value when said post-transient error does not lie within the predetermined range.

7. An air-fuel ratio controller for a water-cooled engine having a cylinder, an intake passage surrounded by a wall which provides air to and said cylinder, and a fuel injector injecting fuel in said intake passage, comprising:

sensors for detecting engine load and speed, means for computing a basic fuel injection amount of said fuel injector based on the detected value of the engine load and speed, a sensor for detecting engine coolant water temperature, a sensor for detecting a real mixing ratio of the fuel and air provided in said cylinder by said fuel injector and intake passage, means for detecting a mixing ratio error from a difference between the value detected by said real mixing ratio sensor and a predetermined target mixing ratio, means for judging whether or not the engine is in a transient state, means for computing a basic correction amount regarding a wall flow of fuel flowing along said wall of said intake passage according to said detected water temperature, means for performing learning related to said basic correction amount of said wall flow based on the mixing ratio error detected by said mixing ratio error detection means when the engine is in the transient state, a memory for storing values learned by said learning performing means, as transient learned values, means for searching said memory for a transient learned value when the engine re-enters the transient state, means for computing a wall flow correction amount based on said searched transient learned value and said basic correction amount of the wall flow, means for correcting said basic fuel injection amount by said computed wall flow correction amount, means for outputting said corrected injection amount to said fuel injector, means for updating said transient learned value stored in said memory such that said mixing ratio error under the transient state decreases, means for judging whether the engine is in a post-transient state, means for judging whether the engine is in a pre-transient state, means for judging whether or not the difference between said mixing ratio error detected in the pre-transient state and the post transient state, lies within a predetermined range, and means for prohibiting updating of said transient learned value when said difference does not lie within the predetermined range.

8. An air-fuel ratio controller for a water-cooled engine having a cylinder, an intake passage surrounded by a wall which provides air to said cylinder, and a fuel injector injecting fuel in said intake passage, comprising:

sensors for detecting engine load and speed, means for computing a basic fuel injection amount of said fuel injector based on the detected value of the engine load and speed, means for computing a target mixing ratio at a regular time period, a sensor for detecting a real mixing ratio of the fuel and air provided in said cylinder by said fuel injector and intake passage, means for computing a feedback correction amount of said mixing ratio based on a value detected by said real mixing ratio sensor at the same time period as said target mixing ratio, means for computing a target mixing ratio damping value from said target mixing ratio and said feedback correction amount at a predetermined time period before the current point, and storing it, means for computing a difference between said stored target mixing ratio damping value and said detected real mixing ratio of the current point as a mixing ratio error, a sensor for detecting engine coolant water temperature, means for judging whether or not the engine is in a transient state, means for computing a basic correction amount regarding a wall flow of fuel flowing along said wall of said intake passage according to said detected water temperature, means for performing learning related to said basic correction amount of the wall flow based on the mixing ratio error detected by said mixing ratio error detection means when the engine is in the transient state, a memory for storing values learned by said learning performing means, as transient learned values.

means for searching said transient learned value when the engine re-enters the transient state, means for computing a wall flow correction amount based on said searched transient learned value and said basic correction amount of the wall flow, means for correcting said basic fuel injection amount by said computed wall flow correction amount, means for outputting said corrected injection amount to said fuel injector, and means for updating a transient learned value stored in said memory such that said mixing ratio error under the transient state decreases.

9. An air-fuel ratio controller for a water-cooled engine having a cylinder, an intake passage surrounded by a wall which provides air to said cylinder, and a fuel injector injecting fuel in said intake passage, comprising:

sensors for detecting engine load and speed, means for computing a basic fuel injection amount of said fuel injector based on the detected value of the engine load and speed, means for computing a target mixing ratio at a regular time period, a sensor for detecting a real mixing ratio of the fuel and air provided in said cylinder by said fuel injector and intake passage, means for computing a feedback correction amount of said mixing ratio based on a value detected by said real mixing ratio sensor at the same time period as said target mixing ratio, means for computing a target mixing ratio damping value from said target mixing ratio and said feedback correction amount at a predetermined time period before the current point, and storing it, means for computing a difference between said stored target mixing ratio damping value and said detected real mixing ratio of the current point as a mixing ratio error, means for judging whether or not the engine is in a steady state, means for performing learning related to said basic fuel injection amount based on said mixing ratio error in the steady state, a memory for storing values learned by said learning performing means, as steady state learned values, means for searching said memory for a steady learned value when the engine re-enters the steady state, means for correcting said basic fuel injection amount by said searched steady state learned value and said feedback correction amount so as to determine a fuel injection amount in steady state, means for outputting said injection amount to said fuel injector, and means for updating a steady state learned value stored in said memory such that said mixing ratio error in the steady state decreases.

* * * * *